US009221096B2

(12) United States Patent
Foltz, IV et al.

(10) Patent No.: US 9,221,096 B2
(45) Date of Patent: Dec. 29, 2015

(54) CENTRIFUGAL CASTING APPARATUS AND METHOD

(71) Applicant: ATI PROPERTIES, INC., Albany, OR (US)

(72) Inventors: John W. Foltz, IV, Albany, OR (US); Raul A. Martinez-Ayers, Albany, OR (US); Aaron L. Fosdick, Albany, OR (US)

(73) Assignee: ATI PROPERTIES, INC., Albany, OR (US)

( * ) Notice: Subject to any disclaimer, the term of this patent is extended or adjusted under 35 U.S.C. 154(b) by 0 days.

(21) Appl. No.: 13/792,929

(22) Filed: Mar. 11, 2013

(65) Prior Publication Data

US 2014/0251570 A1 Sep. 11, 2014

(51) Int. Cl.

| | |
|---|---|
| ***B22D 13/00*** | (2006.01) |
| ***B22D 13/10*** | (2006.01) |
| ***B22D 27/04*** | (2006.01) |

(52) U.S. Cl.

CPC ..... *B22D 13/00* (2013.01); *B22D 13/101* (2013.01); *B22D 27/045* (2013.01)

(58) Field of Classification Search

CPC ..... B22D 13/00; B22D 13/04; B22D 13/12; B22D 13/101; B22D 27/045

USPC ..... 164/175, 286, 289, 290, 292, 293, 296

See application file for complete search history.

(56) References Cited

U.S. PATENT DOCUMENTS

| | | | | |
|---|---|---|---|---|
| 4,519,971 | A * | 5/1985 | Schaer | 264/311 |
| 5,119,865 | A * | 6/1992 | Mae et al. | 164/114 |

(Continued)

FOREIGN PATENT DOCUMENTS

| | | | |
|---|---|---|---|
| DE | 19639514 | C1 | 12/1997 |
| EP | 0686443 | A1 | 12/1995 |
| JP | 3-189057 | A | 8/1991 |

(Continued)

OTHER PUBLICATIONS

Achtermann et al., "Production of γ-TiAl based feed stock materials for subsequent investment casting and forging operations", Sep. 15, 2011, Gfe, 24 pages.

(Continued)

*Primary Examiner* — Keith Walker
*Assistant Examiner* — Steven Ha
(74) *Attorney, Agent, or Firm* — K&L Gates LLP

(57) ABSTRACT

A centrifugal casting apparatus includes a rotatable assembly to rotate about a rotation axis. The rotatable assembly includes a sprue chamber positioned about the rotation axis and is shaped to receive a supply of molten material. A first gate and a second gate are positioned to receive molten material from the sprue chamber in a general direction of centrifugal force. A first cavity and a second cavity are stacked and are respectively positioned to receive molten material from the first gate and the second gate in the general direction of centrifugal force.

62 Claims, 15 Drawing Sheets

(56) References Cited

U.S. PATENT DOCUMENTS

| | | | | |
|---|---|---|---|---|
| 5,311,655 | A | 5/1994 | Jager et al. | |
| 6,443,212 | B1 | 9/2002 | Choudhury et al. | |
| 6,499,529 | B1 | 12/2002 | Farkas | |
| 6,776,214 | B2 | 8/2004 | Ray et al. | |
| 6,935,406 | B2 | 8/2005 | Flemings et al. | |
| 8,136,572 | B2 | 3/2012 | Renkel | |
| 8,347,485 | B2 | 1/2013 | Biederman et al. | |
| 2003/0042001 | A1 * | 3/2003 | Ray et al. | 164/529 |
| 2012/0207611 | A1 | 8/2012 | Luckow et al. | |

FOREIGN PATENT DOCUMENTS

| | | | |
|---|---|---|---|
| JP | 8-206807 | A | 8/1996 |
| JP | 8-238555 | A | 9/1996 |

OTHER PUBLICATIONS

Casting (metalworking), Wikipedia, http://en.m.wikipedia.org/wiki/Casting_(metalworking), 23 pages.

U.S. Appl. No. 14/169,665, filed Jan. 31, 2014.

* cited by examiner

CENTRIFUGAL CASTING APPARATUS AND METHOD

BACKGROUND OF THE TECHNOLOGY

1. Field of the Technology

The present disclosure generally relates to equipment and techniques for centrifugal casting. The present disclosure more specifically relates to equipment and techniques for centrifugal casting of metallic materials.

2. Description of the Background of the Technology

Metallic casting generally includes supplying a volume of molten metallic material to a static or rotating mold and allowing the material to cool to produce a casting shaped by the mold. Castings may be cast in near net form or may be further modified in subsequent forging or machining applications to produce final components. Metallic materials shrink during phase transition from liquid to solid, which may result in castings comprising uncontrolled shrinkage porosity, especially in difficult to cast metallic materials such as, for example, titanium aluminide (TiAl) based alloys and other TiAl materials. Shrinkage porosity is inherent to the fundamental solidification mechanics and may negatively impact microstructure as well as casting yield. In general, minimized internalized porosity may be addressed by processing techniques such as hot isostatic pressing (HIP). However, uncontrolled internal porosity may result in surface distortions affecting surface quality of the casting and increase production costs. Uncontrolled internal porosity may also be exposed when castings are sectioned or separated from casting components. When porosity is surface connected, current processing techniques may be unsuitable for many casting applications. For example, surface treatment techniques designed to fill or enclose porosity may fail to maintain the continuity of the casting, which may detrimentally affect mechanical properties of the cast material. Material removal techniques such as machining to remove external porosity may also reduce casting yield and expose additional porosity.

Conventional casting techniques for casting various metallic materials, such as titanium aluminide based alloys, are incapable of controlling porosity such that the porosity is internalized away from both the surface of a casting and regions of the casting that may be subsequently sectioned. For example, others have described preparation of titanium aluminide sections using a series of static casting and vacuum arc remelting techniques. These static casting techniques, however, create significant porosity, which cannot be removed using HIP. Others have also described centrifugal casting techniques for preparation of titanium aluminide castings that require supplying molten material to the centrifuge before the centrifuge reaches rotational speed. Cooling rate and solidification, however, are difficult to control, as is evident by the requirement of a separate heating method and mold for each cast piece. Although various other centrifugal casting techniques have been reported, none are able to adequately control shrinkage porosity.

Given the drawbacks associated with conventional casting techniques for casting metallic materials, including centrifugal casting techniques, it would be advantageous to develop improved techniques for casting metallic materials.

SUMMARY OF THE TECHNOLOGY

According to one aspect of the present disclosure, a non-limiting embodiment of a centrifugal casting apparatus comprises a rotatable assembly configured to rotate about a rotation axis. The rotatable assembly comprises a sprue chamber positioned about the rotation axis and is structured to receive a supply of molten material. A first gate and a second gate are positioned to receive molten material from the sprue chamber in a general direction of centrifugal force. A first cavity and a second cavity are stacked and are respectively positioned to receive molten material from the first gate and the second gate in the general direction of centrifugal force.

According to another aspect of the present disclosure, an non-limiting embodiment of a centrifugal casting mold comprises a front face configured to receive a supply of molten material, a back face, a first cavity, and a second cavity. The first and second cavities each extend from the front face toward the back face and are defined by a sidewall and a back wall adjacent to the back face of the mold. The first and second cavities are stacked and are configured to receive molten material in a general direction of centrifugal force. The mold is structured to differentially insulate the first and second cavities such that a rate of heat extraction from the molten material is greater at the back walls than a rate of heat extraction at the sidewalls to promote directional solidification from the back wall generally toward the general direction of centrifugal force.

According to another aspect of the present disclosure, an non-limiting embodiment of a permanent centrifugal casting mold comprises a front face configured to receive a supply of molten material, a back face, and a first cavity extending from the front face toward the back face. The first cavity is defined by a sidewall and a back wall adjacent to the back face of the mold. A first gate defined in the mold is positioned between the front face and the first cavity.

According to another aspect of the present disclosure, a centrifugal casting method of producing a casting of a metallic material comprises positioning a rotatable assembly comprising a plurality of gates and a plurality of cavities positioned about a sprue chamber such that the plurality of gates and the plurality of cavities are positioned to receive molten metallic material from the sprue chamber in a general direction of centrifugal force. Each of the plurality of gates is coupled to one of the plurality of cavities and at least two of the plurality of cavities are stacked. The method further comprises rotating the rotatable assembly. The method further comprises delivering a supply of molten metallic material to a sprue chamber.

According to another aspect of the present disclosure, a method of assembling a centrifugal casting apparatus comprises positioning a wedge on a rotatable axis. The method also includes positioning at least two molds into sealing engagement with the wedge where each of the at least two molds comprises a front face and defines at least two cavities extending from the front face into the mold. The method further includes defining a sprue chamber structured to receive molten material where least a portion of the sprue chamber is defined by at least a portion of the front faces of the at least two molds.

BRIEF DESCRIPTION OF THE DRAWINGS

Features and advantages of the apparatus and methods described herein may be better understood by reference to the accompanying drawings in which.

Figure 1:
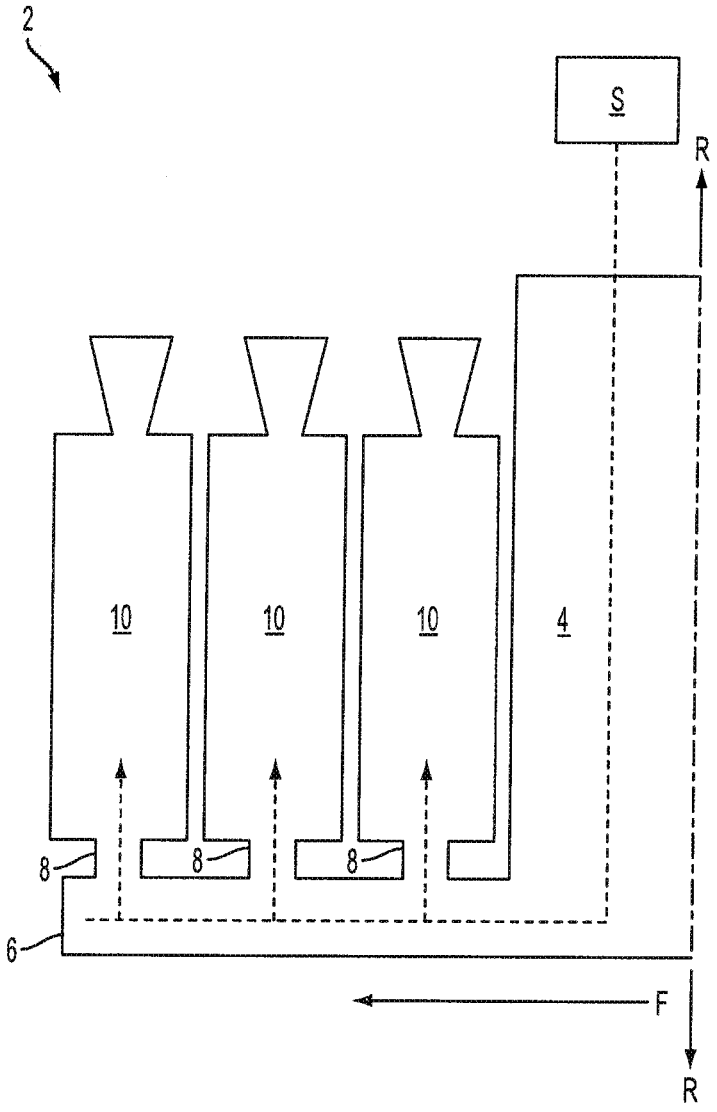
FIG. 1 PRIOR ART
FIG. 1 is a semi-schematic illustration of a rotating assembly of a conventional centrifugal casting assembly.

The reader will appreciate the foregoing details, as well as others, upon considering the following detailed description of certain non-limiting embodiments of apparatuses and methods according to the present disclosure. The reader also may comprehend certain of such additional details upon carrying out or using the apparatuses and methods described herein.

DETAILED DESCRIPTION OF CERTAIN NON-LIMITING EMBODIMENTS

Metallic materials may generally include one or more metal elements, and in some cases also include one or more non-metal elements. Shrinkage porosity is inherent to the fundamental solidification mechanics of many such metallic materials when cast, which may negatively impact mechanical properties of castings. Present static and centrifugal casting techniques for various metallic materials, e.g., titanium aluminide based alloys, are incapable of controlling porosity in both the surface of a casting and in regions where the casting may be subsequently sectioned.

In various non-limiting embodiments, the present disclosure describes centrifugal casting apparatuses comprising rotatable assemblies and components thereof structured to control shrinkage porosity. For example, centrifugal force may be used to feed molten material, such as molten metallic material, into casting pores, thereby minimizing molten material starvation in the solidifying material. Controlled shrinkage porosity may generally include controlling the amount and/or location of shrinkage porosity within a casting such that it may be removed with subsequent processing. For example, controlled shrinkage porosity may include shrinkage porosity that is internalized, e.g., non-surface connected and/or minimized. In some non-limiting embodiments, shrinkage porosity may be internalized away from particular regions of castings such that the castings may be sectioned and/or removed from casting components or material without exposing internalized porosity to the atmosphere.

According to certain non-limiting embodiments, the disclosed centrifugal casting apparatuses and methods may streamline subsequent processing of various castings and eliminate standard production routes such as those used in investment casting. In contrast to conventional centrifugal casting devices, which often require assembly of sixty or more mold components, certain non-limiting embodiments of the centrifugal casting apparatuses disclosed herein comprise rotatable assemblies that may be assembled from fewer than a typical number of major components, significantly reducing setup time. In various non-limiting embodiments, castings may be heat treated and/or processed by HIP, for example. According to certain non-limiting embodiments, castings produced by the disclosed centrifugal casting apparatuses and methods may be suitable for subsequent use in forging or machining applications to produce final components for jet engines, turbochargers, or various high temperature components, for example.

The apparatuses and methods according to the present disclosure may be used in casting metallic materials. As used herein, metallic materials may comprise metal and metal alloys. Metallic materials include, for example, TiAl materials, which comprise, for example, TiAl based alloys. TiAl based alloys may include one or more alloying elements in addition to titanium and aluminum. In certain non-limiting embodiments, the present apparatuses and methods may be used to cast TiAl materials comprising titanium and about 25.0 to 52.1 atomic percent aluminum or about 14 to 36 weight percent aluminum. The disclosed centrifugal casting apparatuses and methods may be used to produce castings of TiAl materials comprising other percentages of aluminum and other alloying elements, without limitation of the above. It is also to be appreciated that while various non-limiting embodiments and beneficial features may be described herein in terms of TiAl based alloys and other TiAl materials, the disclosed apparatuses and methods are not so limited. Those having skill in the art will recognize that the disclosed apparatuses and methods may find wide application beyond TiAl materials, such as, for example and without limitation, metallic materials that suffer from shrinkage porosity or have other properties or characteristics similar to TiAl materials. While certain non-limiting embodiments may provide significant advantages over conventional casting techniques when applied to TiAl materials, it is to be understood that the apparatuses and methods disclosed herein may also be used to cast other metallic materials without limitation to benefits or advantages over conventional casting techniques.

TiAl materials have traditionally been cast using static investment casting techniques. More recently, various centrifugal casting techniques, including centrifugal investment casting, have been proposed for casting TiAl materials. The above techniques, however, may allow voids to form in deleterious locations within the final cast pieces and therefore may increase production costs, limit mechanical properties, and/or impair structural characteristics of the final cast pieces. These techniques are also limited in both the number of cavities and castings per cavity. FIG. 1 illustrates a semi-schematic of a conventional centrifugal casting device 2. The device 2 generally requires supplying molten material from a material supply source "S" to a sprue chamber 4 positioned near a rotation axis "R," about which the device 2 rotates during operation. The device 2 employs indirect gating, which requires routing the molten material (shown as hatched lines) through a runner system 6 to a series of gates 8 positioned at entrances of respective mold cavities 10. Indirect gating feeds molten material to cavities in a direction other than aligned with the direction of centrifugal force "F", such as vertically, as shown in FIG. 1, or in the direction opposite to the centrifugal force, as described in U.S. Patent Application Publication US 2012/0207611 A1, for example. As such, molten material must travel an increased radial distance along various runners 6 to reach additional vertical gating components 8 that must also be traveled before reaching the entry port of the casting cavity 10. The various runners 6, and often the vertical gating components 8, are not in-line with the cast part. Thus, the molten material must enter the casting cavity 10 counter to the centrifugal force. The cross-section of the casting cavity 10 is also larger than the various runners 6, gating 8, and entry port. Thus, in addition to reducing yield due to runner loss, the device 2 is unable to adequately control shrinkage porosity and is susceptible to premature solidification, poor mold fill, and molten material starvation.

Direct gating differs from indirect gating in that the molten material is fed to the cavity generally in the direction of centrifugal force. Direct gating is not used in conventional centrifugal casting devices because indirect gating may reduce turbulence in the mold.

Figure 2:
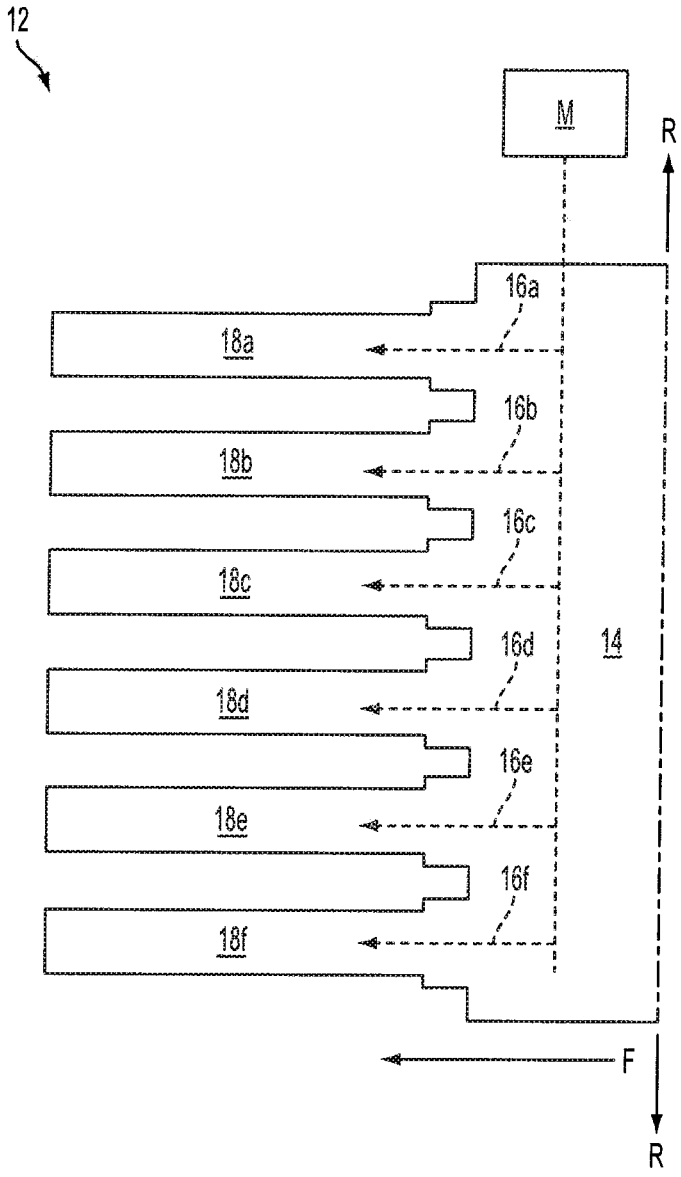
FIG. 2 is a simplified semi-schematic depiction of certain components of a rotating assembly of a centrifugal casting apparatus according to various non-limiting embodiments of the present disclosure.

Referring to FIG. 2, illustrating a simplified semi-schematic depiction of certain components of one non-limiting embodiment of a centrifugal casting apparatus according to the present disclosure, a rotating assembly 12 of a centrifugal casting apparatus may be configured with a direct gating system that reduces yield loss and uses centrifugal force to control shrinkage porosity for production of dense castings. For example, in various non-limiting embodiments, a molten material source "M" may supply molten material (shown generally as hatched lines) to a sprue chamber 14 positioned on or adjacent to an axis of rotation "R" for the rotatable assembly 12. A series of gates 16*a*-16*f*, each coupled to a stacked mold cavity 18*a*-18*f*, may couple to the sprue chamber 14 to deliver molten material to the cavities 18*a*-18*f* generally in the direction of centrifugal force "F". In operation, for example, a vacuum arc remelting (VAR) skull melter (shown generally as molten material supply) may be used to produce a superheated melt of molten material that may be poured from the skull crucible through a funnel positioned above the sprue chamber 14. The superheated molten material may enter the sprue chamber 14 and begin filling the cavities 18*a*-18*f* through the adjacent gates 16*a*-16*f* until all the cavities 18*a*-18*f* are filled. According to various non-limiting embodiments, the gates 16*a*-16*f* coupled to the stacked cavities 18*a*-18*f* may be bathed in liquid molten material during at least one period of mold filling. For example, the sprue chamber 14 may be filled with superheated molten material such that all gates 16*a*-16*f* are completely submerged. In various non-limiting embodiments, one or more cavities 18*a*-18*f* are dimensioned to form multiple final pieces. For example, a gate 16*a*-16*f* may be coupled to a cavity 18*a*-18*f* dimensioned to produce a casting comprising a plurality of final pieces. In certain non-limiting embodiments, the cast pieces may be aligned along the casting cavity 18*a*-18*f* thereby increasing the number of castings that may be produced per gate.

Conventional centrifugal casting gating designs feed molten material to cavities through restricted paths, often including distinct choke points. For example, the diameter or cross-sectional area of the gates 8 in the device 2 shown in FIG. 1 are greater than the diameter or cross-sectional area of the respective casting cavities 10 attached to each gate 8. In contrast, as shown in FIG. 2, various non-limiting embodiments of the disclosed centrifugal casting apparatuses 12 may include gates 16*a*-16*f* comprising diameters or cross-sectional areas greater than those of the cavity 18*a*-18*f* or casting. For example, in some non-limiting embodiments, a volume of a length of the gate 16*a*-16*f* is greater than a volume of an equivalent length of the cavity 18*a*-18*f*. For example, a length of the gate 16*a*-16*f* adjacent to the cavity 18*a*-18*f* may comprise a larger volume than the adjacent area of the cavity 18*a*-18*f* having an equivalent length.

Known centrifugal casting techniques for TiAl materials connect a single gate 8 to a cavity 10 to produce each final cast piece, as shown in FIG. 1. Accordingly, to produce a significant number of pieces, the diameter of the sprue chamber 4 must be relatively large, requiring the molten material to travel a substantial distance from the sprue chamber 4 to the cavities 10 as a thin molten layer. When molten material travels as a thin layer, the material may lose superheat, resulting in premature solidification, poor mold fill, and castings having poor surface finish. In contrast, as shown in FIG. 2, the rotatable assembly 12 may employ direct gating to supply molten material to a plurality of stacked cavities 18*a*-18*f* in the general direction of centrifugal force "F." Stacked cavities 18*a*-18*f* may increase the number of castings that may be produced per pour while also reducing the distance that the molten material must travel to reach the mold cavities 18*a*-18*f*. For example, compared to conventional centrifugal casting devices with the same number of gates, the rotatable assembly 12 may comprise a sprue chamber 14 having a reduced diameter. Beneficially, the per gate 16*a*-16*f* volume of molten material may be reduced, and the proximity of the volume of the molten material in the reduced diameter sprue chamber 14 may promote superheat retention. This may maintain fluidity of the molten material to prevent misruns or premature solidification that may obstruct the supply of molten material in the sprue chamber 14 from reaching the solidifying castings. Consequently, runner yield loss may be reduced, product yield may be increased, and surface finish may be improved.

In various non-limiting embodiments, the rotatable assembly 12 comprises mold designs which may control the amount and location of shrinkage porosity such that it may be internalized to the material. The internalized porosity may then be removed through subsequent thermo-mechanical processing. In certain non-limiting embodiments, molds may be fabricated from materials comprising metallic materials, such as iron and iron alloys, e.g., steels, including semi-metallic materials such as graphite. According to one non-limiting embodiment, molds fabricated from such materials may comprise permanent casting molds, e.g., generally reusable casting molds. In various non-limiting embodiments, molds fabricated from the above materials may also reduce or eliminate contamination of the cast product by entrapped oxides. For example, molds used in investment casting are typically made of oxides. During casting, however, the oxide particles making up the mold invariably become entrapped in the investment cast product. The entrapped particles may subsequently react with the material of the cast product and provide a potential fatigue initiation site. Investment casting molds may be engineered to be inert to molten TiAl or the particular alloy being cast, and various chemical and machining methods may be available to partially remove the entrapped particles. Nevertheless, particle entrapment is unavoidable and the above stopgaps are not ideal, especially for castings used to fabricate end products intended for service in high temperature, high stress environments, such as turbines. In addition to reducing or eliminating contamination of the final product by entrapped oxides, molds comprising metallic materials may reduce or eliminate risk of contamination of the recycle loop due to entrapped oxides in scrap. For example, as described above, investment castings often include entrapped oxides and, therefore, scrap, e.g., revert, from investment castings may similarly include entrapped oxides. Consequently, products cast using this recycled scrap may also be contaminated with the entrapped oxides. However, scrap from castings produced in molds fabricated from the above metallic materials, do not have a potential for such inclusions and therefore may be recycled without risk associated with contamination of the recycling loop. Consequently, extensive cleaning of scrap before recycling may not be necessary, thereby saving time and reducing costs. Despite the above benefits, it is also contemplated that some embodiments may comprise molds fabricated with other materials. For example, in various non-limiting embodiments, molds may comprise expendable centrifugal casting molds. Such molds may be fabricated from expendable materials such as sand or oxides, for example.

In certain non-limiting embodiments, molds may be structured to control the solidification process by controlling the cooling rate of regions of the molten material. For example, molds may include insulation features configured to limit the amount and/or rate of thermal energy extraction from the molten material. Insulation features may generally comprise structural or material features associated with the mold and may be configured to modify the heat capacity of a region of the mold and/or rate of heat transfer from the molten material to the mold. In one non-limiting embodiment, the rate of heat transfer from the molten material may be at least partially controlled by the shape of the mold. For example, the thickness of one or more regions of the mold may be increased or reduced to increase or reduce the heat capacity of the region. In one non-limiting embodiment, the rate and/or amount of thermal energy that may be extracted by the mold may be controlled by the density or mass of a region of the mold. For example, in various non-limiting embodiments, one or more pockets (see, e.g., FIG. 9, 332*a*, 338*a*) may be defined in a wall or face of the mold adjacent to the cavity 18*a*-18*f* to reduce the rate of heat transfer from the molten material. In various non-limiting embodiments, pockets may be enclosed, open, evacuated, or comprise a gas or material positioned in the pocket.

In various non-limiting embodiments, molds may be structured to control heat extraction from the molten material and, hence, control cooling of the material. For example, as introduced above, in certain non-limiting+embodiments, a mold may comprise insulation features configured to differentially insulate one or more portions of a cavity 18*a*-18*f*. Differential insulation features may beneficially modify the rate of cooling along one or more regions of the mold to, for example, control solidification of the molten material. For example, mold regions adjacent to the cavity 18*a*-18*f* may be structured such that molten material undergoes directional solidification. In one aspect, molds may be configured to modify cooling such that solidification is directional, e.g., generally toward the sprue chamber 14 or in a direction opposed to the centrifugal force. In this way, the mold may establish a solidification front within the cavity 18*a*-18*f* that generally progresses toward the gate 16*a*-16*f* and the sprue chamber 14. Thus, the centrifugal force generated by the rotation of the apparatus 12 may generally be opposed to the direction of solidification. For example, in certain non-limiting embodiments, molten material may be supplied to the solidification front to compensate for the shrinkage porosity. Additionally, casting pressure generated by the centrifugal force may force molten metal between dendrites forming near the solidification front to, for example, reduce molten material starvation and minimized shrinkage porosity. Consequently, in various non-limiting embodiments, the disclosed apparatuses and methods may avoid molten material starvation and overcome dendrite exclusion to produce denser castings having reduced shrinkage porosity compared to castings produced by conventional stationary and centrifugal casting techniques.

In various non-limiting embodiments, delivery of the supply of molten metallic material to the cavities 18*a*-18*f* is in-line with the cavities and the centrifugal force. For example, in one non-limiting embodiment, the cavities 18*a*-18*f* are coupled to the sprue chamber 14 via gates 16*a*-16*f* disposed between the sprue chamber 14 and the cavities 18*a*-18*f*. Various dimensions of the gates 16*a*-16*f* may be larger than corresponding dimensions of the cavities 18*a*-18*f*. The gates 16*a*-16*f* may further be in-line with both the cavities 18*a*-18*f* and the supply of molten metallic material in the sprue chamber 14, e.g., comprising a path generally in-line with the centrifugal force such that molten material may be accelerated toward and into the cavities 18*a*-18*f* by the centrifugal force. As a result, the sprue chamber 14 may act as a central riser for all the gates 16*a*-16*f* attached to it. In various non-limiting embodiments, this may eliminate the need for additional risers that may or may not be in-line with the cavities. Thus, such synergy between equipment design, volume of molten material, and available casting area may beneficially provide additional space for additional castings. For example, as stated above, multiple pieces may be cast within a single casting cavity 18*a*-18*f*.

Figure 3:
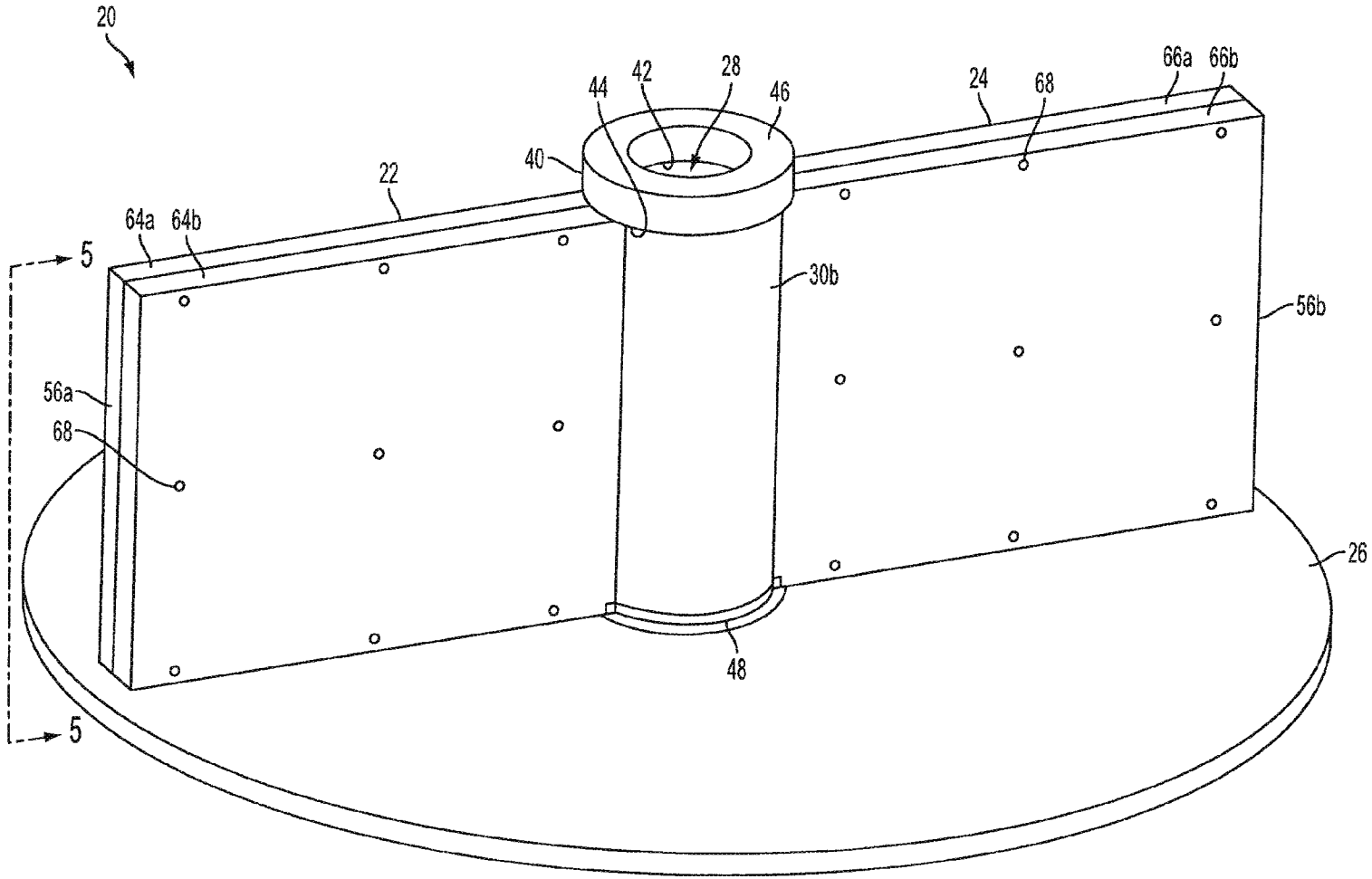
FIG. 3 is a perspective view of certain components of a rotating assembly of a centrifugal casting apparatus according to various non-limiting embodiments of the present disclosure.
Figure 4:
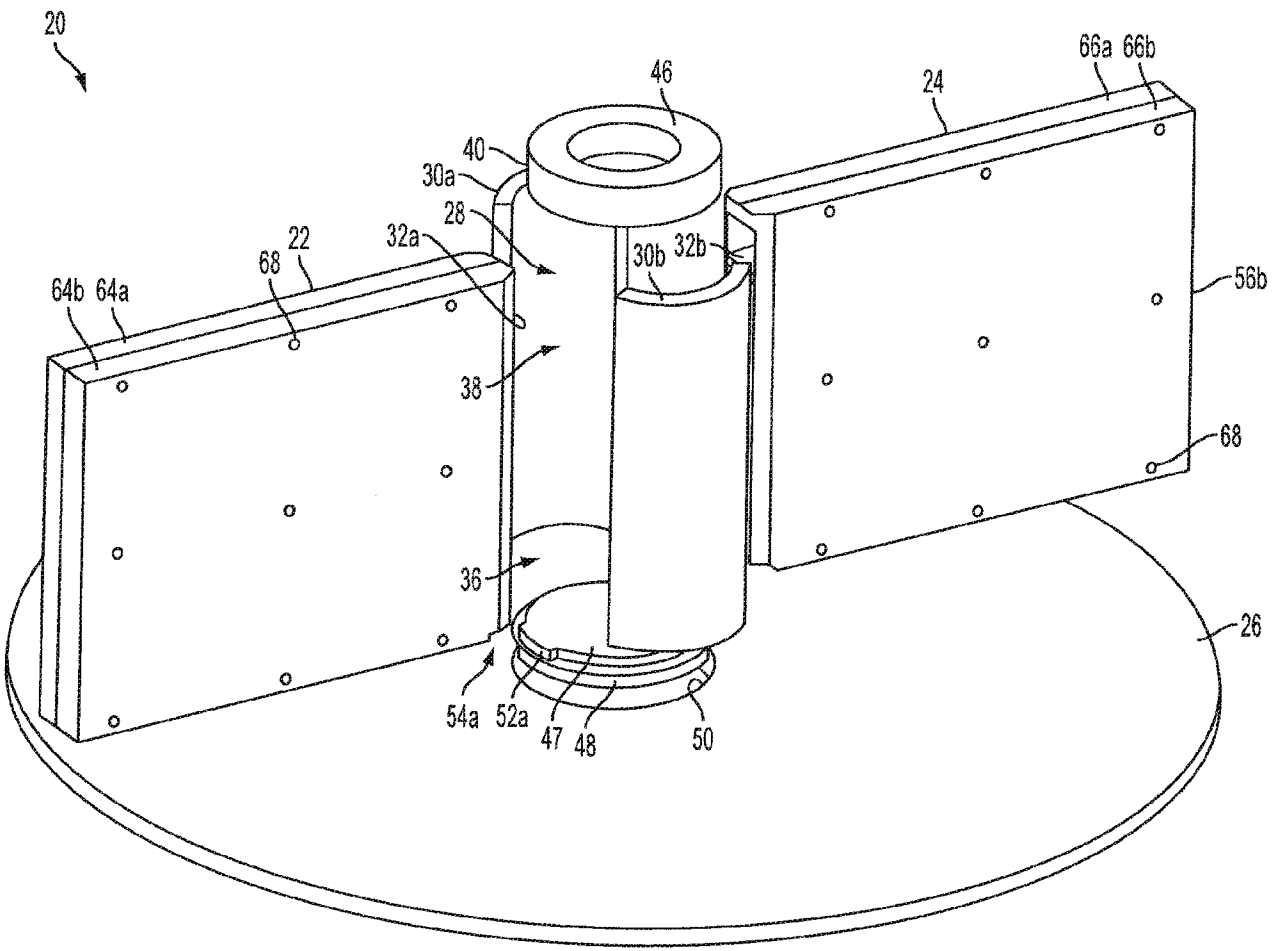
FIG. 4 is a partially exploded view shown in perspective of certain components of the rotating assembly illustrated in FIG. 3 according to one non-limiting embodiment of the present disclosure.
Figure 5:
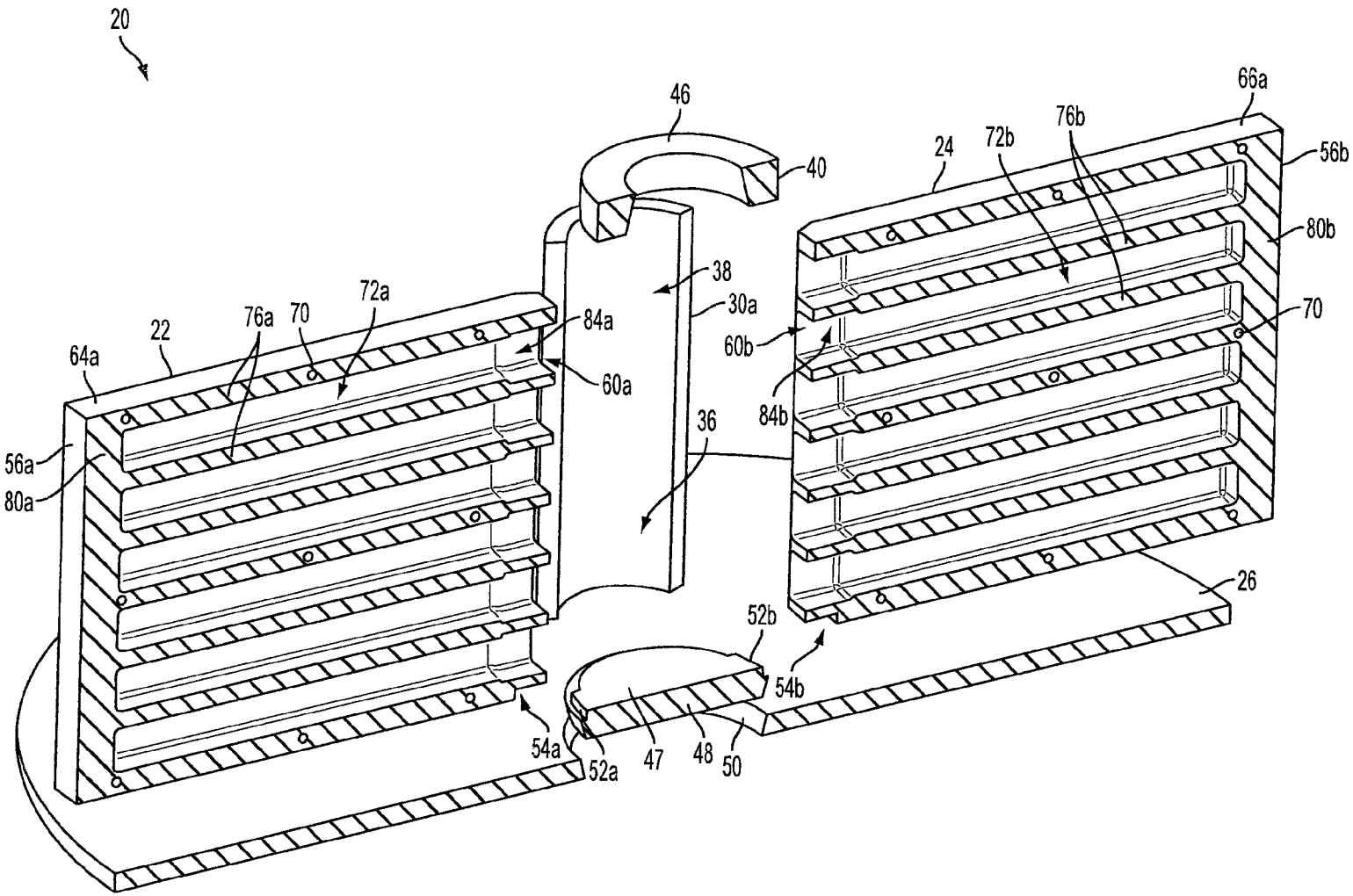
FIG. 5 is a partially exploded view shown in perspective of certain components of the rotating assembly illustrated in FIG. 3, illustrating a table, a wedge, and a containment ring in cross-section taken along line 5-5 and in the direction of the arrows in FIG. 3, according to one non-limiting embodiment of the present disclosure.

FIGS. 3-5 illustrate a centrifugal casting apparatus comprising a rotatable assembly 20 according to various non-limiting embodiments. The rotatable assembly 20 comprises a first mold 22 and a second mold 24 positioned on a rotatable table 26. A sprue chamber 28 is defined by first and second sprue sections 30*a*, 30*b* and respective front faces 32*a*, 32*b* of the first and second molds 22, 24. A first end 36 of the sprue chamber 28 is positioned on the table 26 about the rotation axis. A second end 38 of the sprue chamber 28 is configured to receive a supply of molten metallic material, e.g., from a crucible positioned above the sprue chamber 28. The first and second sprue sections 30*a*, 30*b* are configured for sealing engagement with the first and second molds 22, 24 and table 26 to seal the sprue chamber 28. While the illustrated sprue chamber 28 is shown as comprising a generally cylindrical cross-section, in various non-limiting embodiments, the sprue chamber 28 may comprise irregular or regular dimensions such as triangular, square, rectangular, octagonal, or other cross-sections. In various non-limiting embodiments, the molten material may be supplied to the sprue chamber 28 via gravity, pressure, vacuum, or a combination thereof. For example, according to one non-limiting embodiment, the centrifugal casting apparatus 20 may comprise a vacuum arc remelting device (not shown) for generating a molten metallic material supply that may be poured into the sprue chamber 28.

A containment ring 40 is positioned adjacent to the first end 36 of the sprue chamber 28 and is structured to retain molten material within the sprue chamber 28. For example, in one non-limiting embodiment, the containment ring 40 comprises an extension to the sprue chamber 28, thereby increasing the volume of the sprue chamber 28 and/or the distance molten material must travel to exit the top end of the sprue chamber 28. The containment ring 40 defines a central diameter through which molten material may be supplied to the sprue chamber 28. The central diameter of the containment ring 40 is reduced relative to the diameter of the sprue chamber 40 such that the containment ring 28 forms an internal overhang 42 within the sprue chamber 28 to improve containment of the molten material. For example, in various non-limiting embodiments, the containment ring 40 may limit molten material from splashing or flowing out of the sprue chamber 28 during pouring and/or rotation. The containment ring 40 further defines an outer diameter comprising an external overhang 44 with respect to the sprue sections 30*a*, 30*b*. In the illustrated non-limiting embodiment, the top surface 46 of the containment ring 40 extends outward with respect to the rotation axis, beyond the sprue chamber 28, to thereby catch molten material about its top surface 46 that may splash out of the sprue chamber 28 during operation.

The second end 38 of the sprue is coupled to the table 26 via a wedge 48, as shown most clearly in FIG. 4, providing a partially exploded view of the rotating assembly 20 showing the table 26, wedge 48, and containment ring 40 in cross-section taken along line 5-5 and in the direction of the arrows in FIG. 3. The wedge 48 may form a base 47 of the sprue chamber 28 and be fixed to the rotation axis of the rotatable assembly 20. The illustrated wedge 48 is fixed to the rotation axis via the table 26 through a wedge fitting 50 defined in the table 26. The wedge 48 may further comprise one or more fittings configured for sealing engagement with the sprue sections 30*a*, 30*b* and/or molds 22, 24. For example, in various non-limiting embodiments, the wedge 48 comprises a flange fitting 50 for sealing engagement with components of the rotatable assembly 20. The wedge 48 defines two notches 52*a*, 52*b* configured for engagement with slots 54*a*, 54*b*, which are defined in the first and second molds 22, 24, respectively. In certain non-limiting embodiments, the wedge 48 may be susceptible to mechanical deterioration and, therefore, may comprise a separate, e.g., modular, component that may be replaceable if needed. Similarly, in certain non-limiting embodiments the wedge 48 may comprise various attachment designs such that the wedge 48 may be used to modify or retrofit centrifugal casting apparatuses for use according to various non-limiting embodiments disclosed herein.

The first and second molds 22, 24 are each coupled to the first and second sprue sections 30*a*, 30*b* and extend generally radially from the rotation axis. Each mold 22, 24 comprises a front face 32*a*, 32*b* and an end face 56*a*, 56*b*. The front face 32*a*, 32*b* is posited along the sprue chamber 28 and defines entrances to the gates 60*a*, 60*b*. As shown in FIG. 5, the first and second molds 22, 24 each comprise first and second modular sections 64*a,b*, 66*a,b*, respectively, that may be separated by removing a series of bolts 68 from bolt slots 70 defined in the molds 22, 24 or by other known attachment and detachment methods. Each mold 22, 24 further includes six stacked cavities 72*a*, 72*b*. Each cavity 72*a*, 72*b* is defined by a sidewall 76*a*, 76*b* and a back wall 80*a*, 80*b*. The entrance to each cavity 72*a*, 72*b* comprises a material supply port 84*a*, 84*b* in fluid communication with the sprue chamber 28 through the gate 58*a*, 58*b* that is positioned between the cavity 72*a*, 72*b* and the sprue chamber 28. While the first and second molds 22, 24 are illustrated as defining both the stacked cavities 72*a*, 72*b* and the respective coupled gates 60*a*, 60*b*, according to various non-limiting embodiments, the gates 60*a*, 60*b* may be independent structures with respect to the cavities 72*a*, 72*b*. For example, the gates 60*a*, 60*b* may be engagable with cavities 72*a*, 72*b* and/or insertable through or unitary with a sprue or sections thereof 30*a*, 30*b*.

According to various non-limiting embodiments, the gates 60*a*, 60*b* comprise a diameter and average cross-sectional area greater than the diameter and average cross-sectional area of the cavities 72*a*, 72*b*. For example, the diameter and cross-sectional area of each gate 60*a*, 60*b* adjacent to the material supply port 84*a*, 84*b* is greater than the diameter and cross-sectional area of the adjacent material supply port 84*a*, 84*b*. In various non-limiting embodiments, a volume of a gate 60*a*, 60*b* is greater than a volume of an equal length of a cavity 72*a*, 72*b* adjacent to the gate 60*a*, 60*b*. It is to be appreciated that while six stacked cavities 72*a*, 72*b* are shown, unless expressly stated otherwise, the present disclosure is not limited to stacked cavities or any specific number of cavities associated with each mold. For example, in various non-limiting embodiments, a mold may define only a single cavity. Similarly, while only two molds 22, 24 are shown in FIGS. 3-5, it is to be understood that the present disclosure and the embodiments disclosed herein are not limited by the number of molds illustrated. Indeed, in various instances, a rotatable assembly comprises a modular design wherein the number and design of the molds may be modified as needed. For example, when fewer castings are desired, certain molds may be removed to suit the application.

In certain non-limiting embodiments, the first and second molds 22, 24 may be structured to control heat extraction from the molten metallic material and, hence, control cooling of the material. For example, the first and second molds 22, 24 may comprise various insulation features configured to produce directional solidification of the material toward the rotation axis. The thickness of the back walls 80*a*, 80*b* may be greater than the thickness of the sidewalls 76*a*, 76*b*. Thus, heat transfer from the molten material to the molds 22, 24 may be controlled by the heat capacity of the walls 76*a*, 76*b*, 80*a*, 80*b* defining each cavity 72*a*, 72*b*. For example, differential insulation features of the molds 22, 24 may include increased heat transfer at the back wall 80*a*, 80*b* compared to heat transfer at the sidewall 76*a*, 76*b* or region thereof. Accordingly, material adjacent to the back walls 80*a*, 80*b* may begin to solidify before material positioned adjacent to the gates 60*a*, 60*b*. In this way, a solidification front may generally progress within each of the stacked cavities 72*a*, 72*b* from the back wall 80*a*, 80*b* toward the gate 60*a*, 60*b* and sprue chamber 28. In addition to establishing a solidification front, in various non-limiting embodiments, the centrifugal casting force generated by the rotation of the molds 22, 24 about the rotation axis is generally opposed to the direction of solidification, thereby preventing molten material starvation and dendrite exclusion that may result in uncontrolled porosity in castings produced by conventional stationary and centrifugal casting techniques. For example, the sprue chamber 28, gates 60*a*, 60*b*, and portions of the cavities 72*a*, 72*b* located ahead of the solidification front may act as a reservoir to forcefully supply molten material to the solidification front to produce dense castings having controlled shrinkage porosity.

In certain non-limiting embodiments, the first and second molds 22, 24 are structured to control heat transfer from the molten metallic material to the mold while not detrimentally decreasing the cooling rate of the material. For example, the first and second molds 22, 24 may be structured to provide various levels of control over the solidification process while also providing increased solidification rates. As those having skill in the art will appreciate, an increased cooling rate may favorably decrease grain size, thereby benefiting mechanical properties of the casting at room temperature. Such an increased cooling rate in conventional designs, however, is difficult to control and results in uncontrolled shrinkage porosity. In contrast, in various non-limiting embodiments, the first and second molds 22, 24 are permanent molds and/or are fabricated from materials including metallic materials to provide increased solidification rates due to a high thermal conductivity that may be associated with the mold material, to thereby promote decreased grain size. For example, in one non-limiting embodiment, the first and second molds 22, 24 comprise a permanent steel mold. The first and second molds 22, 24 may also be structured to promote directional solidification, as described above, without sacrificing grain size due to, for example, a retarded cooling rate. That is, while certain portions of the molds 22, 24 may be differentially thermally insulated relative to other portions of the mold 22, 24, the overall cooling rate may be relatively fast. For example, the first and second molds may be configured to promote a differential cooling rate that is tightly defined, e.g., optimized to promote formation of a solidification front that rapidly progresses from the back wall 80*a*, 80*b* toward the sprue chamber 28.

While not shown in FIGS. 3-5, in various non-limiting embodiments, the mold walls 76*a*, 76*b*, 80*a*, 80*b* may comprise multiple insulation features, such as pockets or other insulation features. For example, mold walls 76*a*, 76*b*, 80*a*, 80*b* may comprise multiple materials having various heat capacities and densities to modulate heat transfer from the molten material. For example, a pocket or void may be defined in a wall adjacent to a cavity. The reduced mass of the wall may limit the ability of the wall to extract heat from the molten material. Accordingly, in various non-limiting embodiments, walls defining pockets may have limited heat capacity thereby limiting the amount of thermal energy that the walls may absorb before thermal saturation is reduced. Accordingly, such walls may insulate the cavity to control heat transfer from the molten metallic material. In various non-limiting embodiments, a cavity 72*a*, 72*b* may be defined by a back wall 80*a*, 80*b* and a sidewall 76*a*, 76*b* comprising a first and second sidewall portion. In some instances, the first and second sidewall portions may comprise the same thickness, while in other instances, the thicknesses of the first and second sidewall portions may be different. For example, when a first sidewall portion is disposed between two cavities, the first sidewall portion may be thicker than the second sidewall portion that is adjacent to only a single cavity. Similarly, in various non-limiting embodiments, as shown in FIGS. 3-5, the molds 22, 24 may be insulated from the table 26 by a boundary layer comprising interfacing surfaces of the molds 22, 24 and the table 26.

Figure 6:
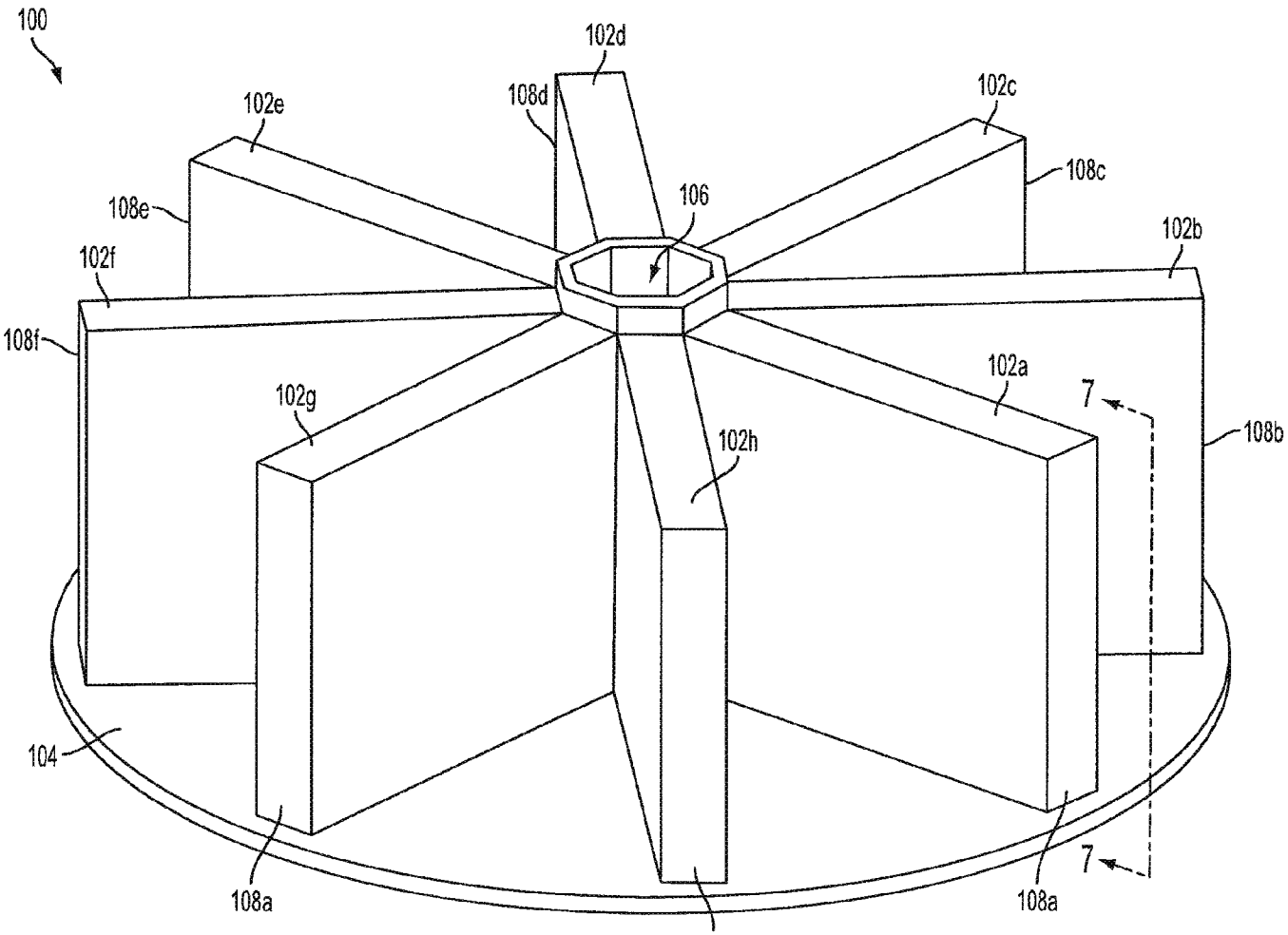
FIG. 6 is a perspective view of certain components of a rotating assembly of a centrifugal casting apparatus according to various non-limiting embodiments of the present disclosure.
Figure 7:
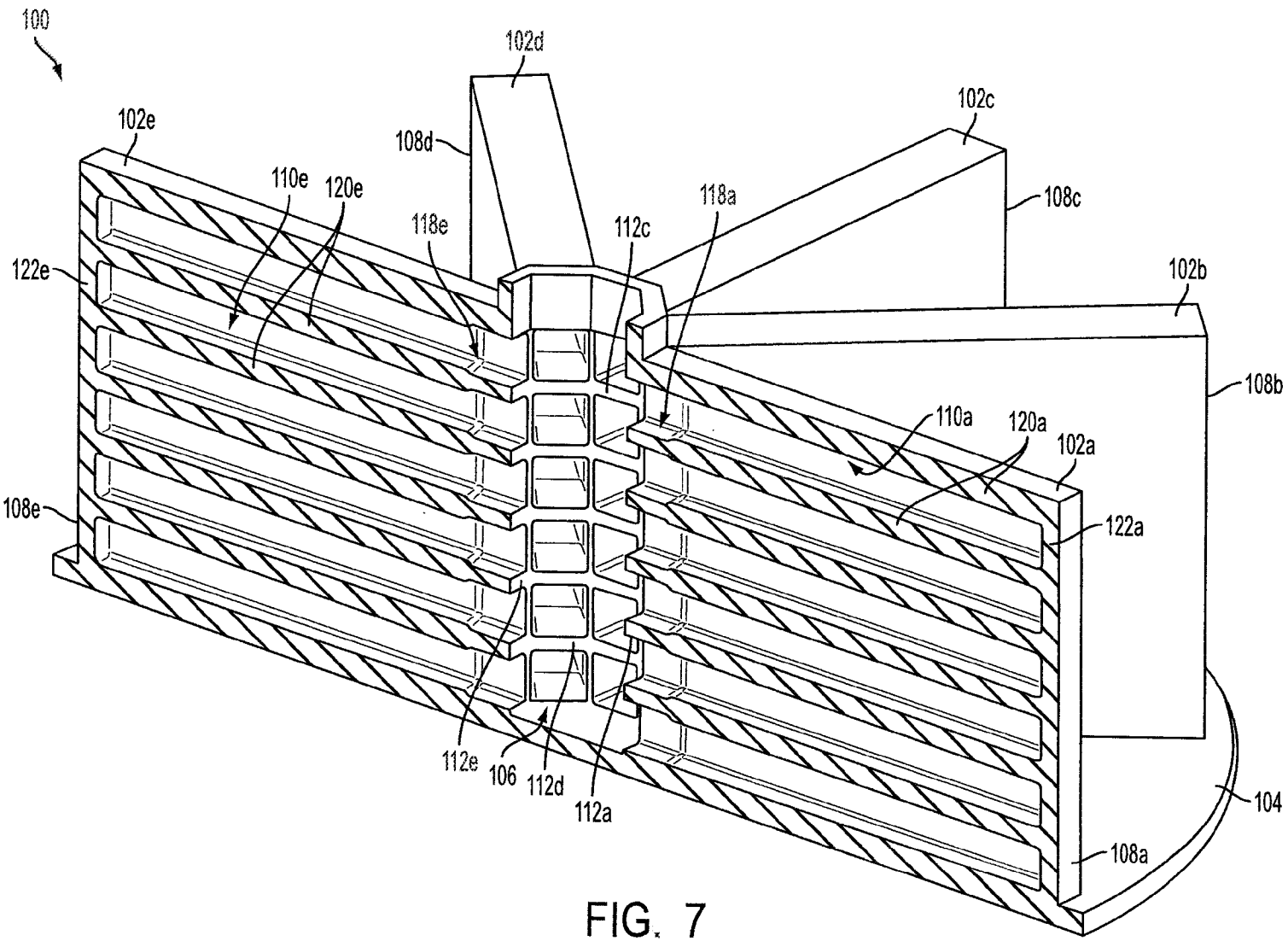
FIG. 7 is a cross-section, taken along line 7-7 and in the direction of the arrows in FIG. 6, illustrating certain components of the rotating assembly illustrated in FIG. 6 according to one non-limiting embodiment of the present disclosure.

FIG. 6 illustrates certain components of a non-limiting embodiment of a centrifugal casting apparatus comprising a rotatable assembly 100 according to various non-limiting embodiments of the present disclosure. The rotatable assembly 100 comprises eight molds 102*a*-102*h*, each positioned on a rotatable table 104. The molds 102*a*-102*h* define a generally octagonal sprue chamber 106 positioned about the rotation axis and radiate generally outward to define back faces 108*a*-108*h*. FIG. 7 illustrates a cross-section of the rotatable assembly 100, taken along line 7-7 and in the direction of the arrows in FIG. 6, and shows a vertical cross-section of six stacked cavities 110*a* and 110*e* defined by molds 102*a* and 102*e*, respectively. The molds 102*a*-102*h* each comprise a front face (only front faces 112*a*,112*c*-112*e* are visible) configured for sealing engagement about the rotation axis to define the sprue chamber 106. The sprue chamber 106 extends from the table 104 to a raised containment ring 114 structured to retain molten material within the sprue chamber 106.

The sprue chamber is in fluid communication with the stacked cavities 110*a*, 110*e* at the material supply ports 116*a*, 116*e* of each of the stacked cavities 110*a*, 110*e* via respective gates 118*a*, 118*e*. The stacked cavities 110*a*, 110*e* are each defined by a sidewall 120*a*, 120*e* and a back wall 122*a*, 122*e*. For brevity, various features of the rotatable assembly 100 may be described with respect to molds 102*a* and 102*e*. It is to be appreciated, however, that in various embodiments, the descriptions apply similarly to one or more additional molds 102*b*-102*c*, 102*f*-102*h*. For example, the six stacked cavities 110*c*, 110*d* of molds 102*c* and 102*d* may also be in fluid communication with the sprue chamber 106 at material supply ports 116*c* and 116*d* via gates 118*c*, 118*d*. The gates 118*a*, 118*e* comprise a diameter and average cross-sectional area greater than the diameter and average cross-sectional area of the respective stacked cavities 110*a*, 110*e* coupled to each of the gates 118*a*, 118*e*. For example, the diameter and cross-sectional area of the gates 118*a*, 118*e* adjacent to the material supply ports 116*a*, 116*e* are greater than the diameter and cross-sectional area of the material supply ports 116*a*, 116*e* or the cavities 110*c*, 110*d*. In various non-limiting embodiments, each gate 118*a*, 118*e* defines a volume greater than a volume defined by an equal length of the cavity 110*a*, 110*e* adjacent to the gate 118*a*, 118*e*.

In operation, the rotatable assembly 100 of the centrifugal casting apparatus utilizes centrifugal forces generated by the rotation of the rotatable assembly 100 to produce castings by centrifugal casting. In one non-limiting embodiment, the centrifugal casting apparatus comprises a vacuum arc remelting apparatus (not shown) configured to consume an electrode of metallic material to be supplied to a crucible, such as a water-cooled copper crucible. For example, the rotatable assembly 100 may be positioned within a vacuum environment such that when the electrode is consumed, the molten metallic material within the crucible may be supplied to the rotatable assembly 100. The rotatable assembly 100 may generally comprise the sprue chamber 106 positioned about the rotation axis and two or more stacked mold cavities 110*a*, 110*e* defined in one more molds 102*a*, 102*e*. While not shown in detail in FIGS. 6-7, each of the stacked mold cavities 110*a*, 110*e* may be structured to form a casting comprising one or more pieces. When the molten metallic material is supplied to the sprue chamber 106, the centrifugal force generated by the rotation of the rotatable assembly 100 accelerates the molten metallic material through the gates 118*a*, 118*e* and into the casting cavities 110*a*, 110*e*. In various non-limiting embodiments, the molds 102*a*, 102*e* may be rotatable to speeds including 100 and 150 rotations per minute (RPM). More preferably, rotational speeds may be greater than 150 RPM. In general, faster rotational speeds may provide castings having improved structure. For example, compared to a rotational speed of 160 RPM, a rotational speed of 250 RPM would produce increased centrifugal force, which may reduce porosity of the cast part. In various embodiments, a relative increase in centrifugal force may allow a relative increase in a solidification rate to promote reduced grain size and/or additional margin of error with respect to controlling directional solidification.

As the molds 102*a*, 102*e* extract heat from the molten metallic material, the material begins to freeze, producing shrinkage porosity. According to various non-limiting embodiments, heat extraction may be limited by the thickness of the walls 120*a*, 120*e*, 122*a*, 122*e* of the mold. For example, in one non-limiting embodiment, the thickness of the sidewalls 120*a*, 120*e* may be less than 1 inch. Accordingly, the thickness of the walls 120*a*, 120*e*, 122*a*, 122*e* may limit the ability of the mold 102*a*, 102*e* to absorb thermal energy from the molten material. As described above, in various non-limiting embodiments, the molds 102*a*, 102*e* are configured to control cooling of the material such that the material undergoes directional solidification from the back walls 122*a*, 122*e* generally toward the axis of rotation or the sprue chamber 106. The dimensions of the gates 118*a*, 118*e* leading to the cavities 110*a*, 110*e* are also large enough to prevent the supply of molten material in the sprue chamber 106 from being cut off from the shrinkage porosity. As a result, most of the porosity may be filled with molten material. When the material in the cavities 110*a*, 110*e* fully solidifies, the respective casting gates 118*a*, 118*e* also freeze, which closes off the molten material that may remain in the sprue chamber 106 from the casting cavities 110*a*, 110*e*. Accordingly, gates 118*a*, 118*e* may be fully dense upon freezing. When the solidified metallic material in the cavities 110*a*, 110*b* is sufficiently cooled to handle and no longer oxidize, the castings may be removed from the molds 102*a*, 102*e*, for example, by unbolting a first modular mold section from a second modular mold section, which may be similar to the arrangement described above with respect to modular mold sections 64*a*, 64*b*. The castings may be removed from the sprue chamber 106 at or near the position where the gates 118*a*, 118*e* meet the sprue chamber 106. Since the gates 118*a*, 118*e* are fully dense, any porosity inside the casting remains internal and may be removed by HIP, for example, to eliminate any internal porosity in the casting. When castings comprise multiple pieces, the fully dense casting may then be divided into the final pieces by machining equipment such as saws, cutting torches, abrasive water jet, or wire electro-discharge machining apparatuses, for example.

As introduced above, in various non-limiting embodiments, the gates 118*a*, 118*e* comprise a diameter or cross-sectional area greater than the largest diameter or cross-sectional area of the cavities 110*a*, 110*e*. In certain non-limiting embodiments, the increased size of the gates 118*a*, 118*e* prevents internal porosity from reaching the sprue chamber 106. For example, a gate 118*a*, 118*e* may be fully dense upon solidification, preventing internal porosity from connecting to the sprue chamber 106 where it may later become exposed when the casting is removed from the sprue chamber 106. Thus, gates 118*a*, 118*e* may form a density barrier to contain the internal porosity such that it may be addressed by processing, such as by HIP, for example. In various non-limiting embodiments, gates 118*a*, 118*b* may form a thermal barrier between casting cavities 110*a*, 110*e* and the sprue chamber 106. For example, the cooling rate of the molten metallic material in the sprue chamber 106 may be well below the cooling rate of the molten metallic material in the cavities 110*a*, 110*e*, resulting in a substantial temperature differential between the cavities 110*a*, 110*e* and the sprue chamber 106 well after an optimal cooling period for the casting has taken place. Consequently, grain size near the sprue chamber 106 may be increased. The gates 118*a*, 118*e* disclosed herein, however, may be configured to solidify closely following the casting, e.g., when the solidification front has extended through the casting, but still before the molten metallic material in the sprue chamber 106 has solidified. According to one non-limiting aspect, the solidified gates 118*a*, 118*b*, which may also be fully dense, thereby form a thermal barrier between the sprue chamber 106 and respective casting cavities 110*a*, 110*e*.

In various non-limiting embodiments, the rotatable assembly 100 comprises a plurality of vertically stacked cavities 110*a*, 110*e* positioned about a sprue chamber 106. The sprue chamber 106 may comprise a decreased radius compared to sprue chambers of conventional centrifugal casting apparatuses that are configured to feed a comparable number of cavities. In operation, according to one non-limiting embodiment, molten material may substantially simultaneously, e.g., continuously, fill the sprue chamber 106, gates 118*a*, 118*e*, and vertical cavities 110*a*, 110*e*. For example, molten material supplied to the sprue chamber 106 may begin to simultaneously fill the sprue chamber 106, adjacent gates 118*a*, 118*e*, and vertical cavities 110*a*, 110*e* from the bottom toward the top. Thus, as the molten material is poured into the sprue chamber 106, the molten material accumulates to form an increasing molten volume in the sprue chamber 106 that may be directly fed to the adjacent gates 118*a*, 118*e* and vertical cavities 110*a*, 110*e* without loss of superheat due to excessive travel and contact with various structures of the rotatable assembly 100. Thus, in various non-limiting embodiments, the sprue chamber 106 is configured to feed all the casting cavities 110*a*, 110*e* while promoting retention of superheat. For example, in operation, the sprue chamber 106 may be dimensioned to receive a single pour of molten material that completely fills a cavity of the vertical stacks of cavities 110*a*, 110*e*. For example, in one non-limiting embodiment, the sprue chamber is dimensioned to receive a single pour of molten material that completely fills at least the bottom cavity of each of the vertical stacks of cavities 110*a*, 110*e*. The volume of the single pour is preferably sufficient to also completely fill the gates 118*a*, 118*e* and the volume of the sprue chamber 106 adjacent to the completely filled cavities 110*a*, 110*e*. Thus, the rotatable assembly 100 may be configured to receive a volume of molten material that may be fed directly from the sprue chamber 106 into the cavities 110*a*, 110*e* without loss of superheat.

According to certain non-limiting embodiments, retaining superheat promotes production of cast pieces comprising improved surface quality. Titanium aluminide castings, for example, produced by conventional casting techniques suffer from poor surface quality. For instance, as stated above, when a thin layer of molten material must travel the radius of a large diameter sprue and subsequently climb various structures, such as sprue walls or gating, for example, to fill from the bottom of the mold cavities, the bulk of the molten material may be unable to retain superheat, resulting in poor surface quality. The poor surface quality may require producing castings several millimeters larger than the final piece so that the surface of the casting may be processed to produce a casting within the desired dimensions. In contrast, the rotatable assembly 100 may be configured to produce castings comprising improved smoothness and without surface defects commonly found in castings produced by conventional techniques. Consequently, castings may be produced with lower scrap rates and production costs.

Figure 8:
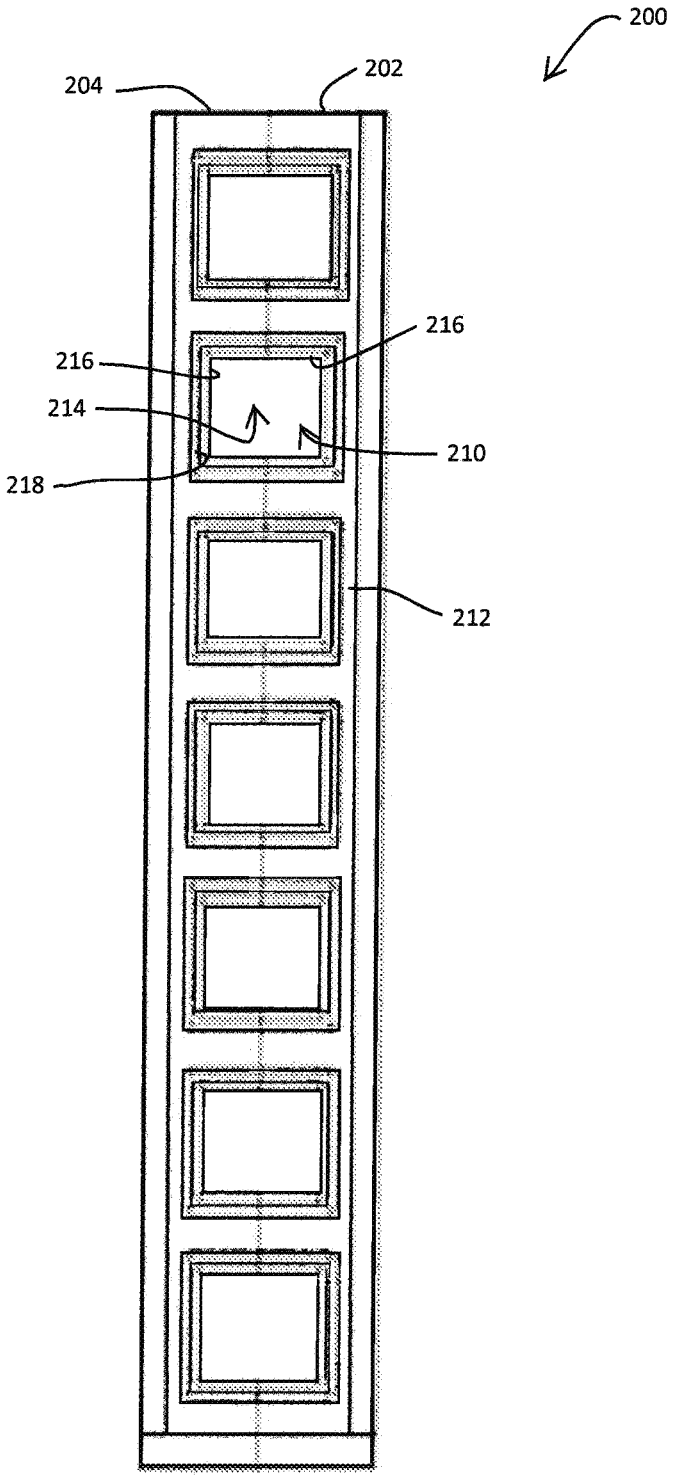
FIG. 8 is a front view of a mold according to one non-limiting embodiment of the present disclosure.

FIG. 8 is a front view of a mold 200 according to certain non-limiting embodiments of the present disclosure. The mold 200 includes first and second modular sections 202, 202 that define seven cavities 210. The cavities 210 extend from a front face 212 of the mold 200 toward a back wall 214 of the mold 200 and are defined between sidewalls 216. In certain non-limiting embodiments, the mold may be structured to control cooling of molten material such that the material undergoes directional solidification from the back walls 214 generally toward the axis of rotation or the sprue chamber, which may be proximate to the front face 212 of the mold 200. The mold further includes gates 218 positioned adjacent to the front face 212 leading to each cavity 210*a*. The gates 218 are dimensioned to prevent the supply of molten material in the sprue chamber from being cut off from the shrinkage porosity. As a result, most of the porosity may be filled with molten material to produce dense castings. For example, the gates 218 comprise a diameter or cross-sectional area greater than the largest diameter or cross-sectional area of the cavities 210. In certain non-limiting embodiments, the increased size of the gates 218 prevents internal porosity from reaching the sprue chamber. For example, a gate 218 may be fully dense upon solidification, preventing internal porosity from connecting to the sprue chamber where it may later become exposed when the casting is removed from the sprue chamber. Thus, the gates 218 may form a density barrier to contain the internal porosity such that it may be addressed by processing, such as by HIP, for example. As described above, in various non-limiting embodiments, the gates 218 may also form a thermal barrier between the casting cavities 210 and the sprue chamber. Consequently, grain size near the sprue chamber may be reduced compared to conventional castings because the material in the gates 218 may solidify closely following the casting, e.g., when the solidification front has extended through the casting, but still before the molten metallic material in the sprue chamber has solidified. As described above, when the solidified material in the cavities 210 has sufficiently cooled, the castings may be removed from the mold 200 by separation of the first and second modular sections 202, 204.

Figure 9:
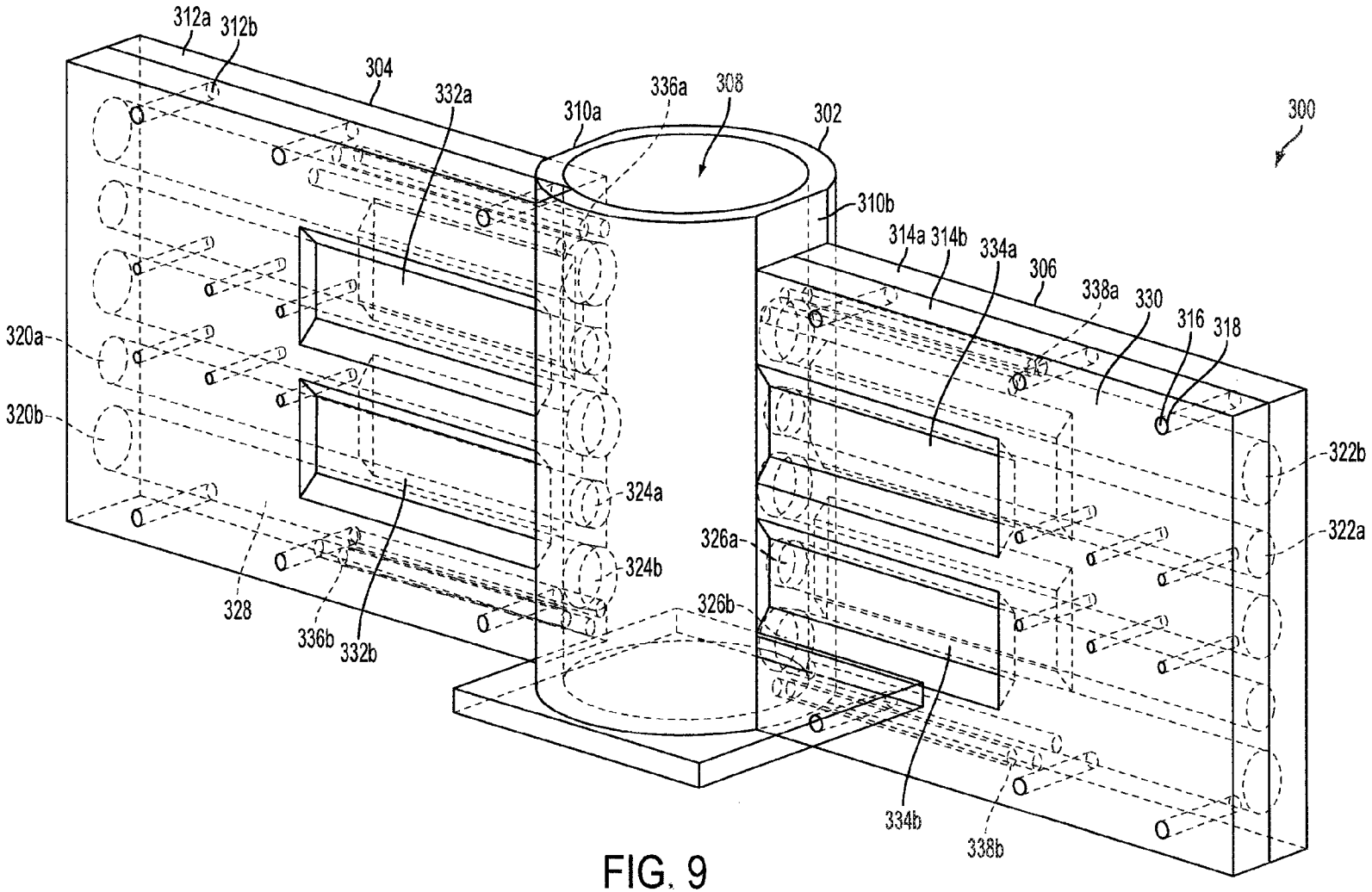
FIG. 9 is a perspective view of certain components of a rotating assembly of a centrifugal casting apparatus according to various non-limiting embodiments of the present disclosure.

FIG. 9 is a perspective view of certain components of a rotatable assembly 300 of a centrifugal casting apparatus according various non-limiting embodiments of the present disclosure. The rotatable assembly 300 comprises a sprue 302 coupled to a first mold 304 and a second mold 306. The sprue 302 is positioned about a rotation axis of the assembly 300 and defines a sprue chamber 308 structured to receive a supply of molten metallic material. The sprue chamber 308 comprises a generally cylindrical shape having a generally circular cross-section. The outer surface of the sprue 302 defines two slots 310*a*, 310*b* for receiving the molds 304, 306. Each mold 304, 306 comprises first and second modular sections 312*a,b*, 314*a,b* attachable via bolts 316, which are insertable through slots 318 defined in the molds 304, 306.

Each mold defines five stacked cavities, wherein two of the cavities 320*a*, 322*a* comprise a decreased diameter compared to three larger diameter cavities 320*b*, 322*b*. The decreased diameter cavities 320*a*, 322*a* are positioned at intervals between the three larger diameter cavities 320*b*, 322*b*. As can be seen, multiple diameter cavities may increase flexibility with respect to casting sizes that may be produced in a single pour. For example, time and yield loss may be reduced by consolidating pours. The stacked cavities 320*a*, 320*b*, 322*a*, 322*b* are in fluid communication with the sprue chamber 308 through respective gates 324*a*, 324*b*, 326*a*, 326*b*. Each gate 324*a*, 324*b*, 326*a*, 326*b* comprises a diameter and cross-sectional area larger than the diameter and cross-sectional area of the cavity 320*a*, 320*b*, 322*a*, 322*b* in which it is coupled. In one aspect, the increased size of the gates 324*a*, 324*b*, 326*a*, 326*b* prevents full solidification of the gates 324*a*, 324*b*, 326*a*, 326*b* until after the material in the respective cavities 320*a*, 320*b*, 322*a*, 322*b* has fully solidified. That is, at least a portion of the material in the gates 324*a*, 324*b*, 326*a*, 326*b* may retain liquidity such that it may move into and fill portions of the solidifying metallic material in the casting cavity 320*a*, 320*b*, 322*a*, 322*b*. As summarized above, in various non-limiting embodiments, gates 324*a*, 324*b*, 326*a*, 326*b* comprise an increased dimension with respect to a dimension of the cavity. For example, according to certain configurations, optimal efficiency with respect to casting volume and yield may include a gate 324*a*, 324*b*, 326*a*, 326*b* comprising a cross-sectional area greater than the cross-sectional area of the cavity 320*a*, 320*b*, 322*a*, 322*b*, for example, between 100% to 150% of the cross-sectional area of the cavity 320*a*, 320*b*, 322*a*, 322*b*. Of course, in some non-limiting embodiments, gates comprising cross-sectional areas up to, for example, 400% or more of the cross-sectional area of the corresponding cavity, may also be used to produce castings having similar characteristics. Yield loss, however, may increase with increasing gate dimensions. According to various configurations of certain non-limiting embodiments, optimal gate lengths may comprise 50% to 150% of the largest dimension of the cross-section of the gate. Again, such lengths are merely optimizations of certain embodiments with respect to the number of castings that may be produced per volume of material supplied to the mold, and such examples are not intended to be limiting unless stated otherwise.

The first and second molds 304, 306 are structured to promote directional solidification generally toward the rotation axis or sprue chamber 308 such that centrifugal force continually presses molten material toward the solidification front of the casting to fill shrinkage porosity as it appears in order to produce a denser casting. The first and second molds 304, 306 comprise insulation features configured to promote directional solidification toward the sprue chamber 308. For example, the molds 304, 306 each comprise a side face 328, 330 defining two pockets 332*a,b*, 334*a,b* spaced apart and positioned proximal to the sprue 302. The pockets are configured to reduce the heat capacity of the mold along the corresponding portion of the mold. The molds 304, 306 further define a plurality of upper and lower pockets 336*a,b*, 338*a,b* extending along a portion of the molds 304, 306. The upper and lower pockets 336*a,b*, 338*a,b* are configured to insulate adjacent portions of the mold by limiting the heat capacity and rate of heat transfer through the mold. In addition to controlling heat transfer by altering heat capacity of portions of the mold via pockets or mass of mold walls, in various non-limiting embodiments, cavities may also be arranged to assist in controlling heat transfer.

Figure 10:
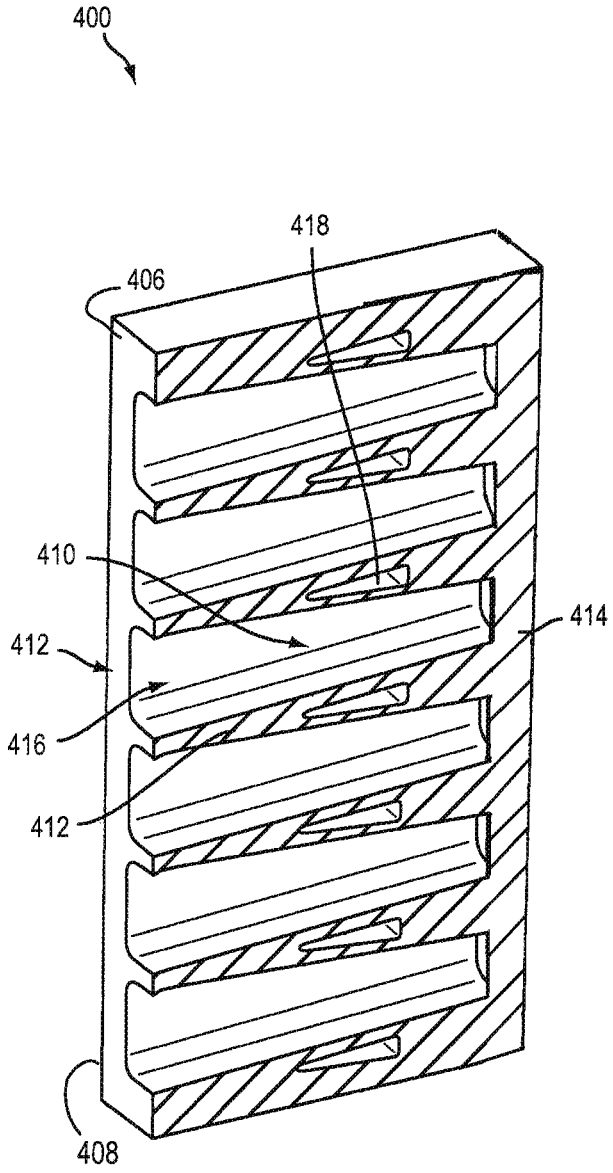
FIG. 10 is a perspective view of a cross-section of a mold according to one non-limiting embodiment of the present disclosure.

FIG. 10 illustrates a cross-section of a mold 400 for a centrifugal casting according to various non-limiting embodiments of the present disclosure. The mold 400 includes a front face 406 and two side faces 408, although only one side face 408 is included in the cross-section. Six cavities 410 are defined within the mold 400 between respective sidewalls 412 and back walls 414.

Each cavity 410 comprises a molten material supply port 416 adjacent to a tapered or decreasing cross-section tapered from the material supply port 416 toward the back wall 414. In various non-limiting embodiments, the front face 406 may be configured to attach to a gate or plate, or directly to a sprue at the molten material supply port 416. For example, in some non-limiting embodiments, a mold 400 comprises a cavity 410 defining a decreasing cross-section over a portion of its length extending from the molten material supply port 416, which may be directly couplable to a sprue or sprue chamber. That is, the reduction in cross-section over an initial length of the cavity 410 may overcome the need for a gate. As such, castings may be produced with reduced yield loss and controlled shrinkage porosity. In various non-limiting embodiments, cavities 410 comprising decreasing cross-sections may define sidewalls 412 generally tapering in-line with the cavity 410, e.g., generally aligned with a centerline of the cavity 410, and may comprise a symmetrical taper with respect to adjacent sidewalls 412 of the cavities 412. In one non-limiting embodiment, a decreasing cross-section may be generally defined along the direction of centrifugal force and/or taper in a general direction opposed to the general direction of solidification. For example, in one non-limiting embodiment, a cavity defines a cross-section, such as a tapered section, that generally tapers away from the molten material supply port, e.g., toward a back wall 414 of the cavity 410.

In one non-limiting embodiment, the cavity 410 defines a decreasing cross-section comprising a tapered section that includes a first cross-section and a second cross-section. The second cross-section is less than the first cross-section and is located a greater distance from the rotation axis than the first cross-section. In operation, a solidification front may be formed and directionally advance generally from the back wall 414 toward first cross-section and the molten material supply port 416. Solidification of the material along the solidification front may result in dendrite formation within the solidifying material. According to various non-limiting embodiments, at least a portion of the molten material in front of the solidification front may remain molten for a period of time during which the material located at or near the second cross-section is subject to cooling and hence shrinkage. In this way, the molten material in front of the solidification front, e.g., at or near the first cross-section, may be accelerated by the centrifugal force such that it moves into and/or between the forming dendrites to fill shrinkage porosity as it arises to avoid formation of significant voids and thereby produce a dense casting. In this way, the portions of the mold in front of the solidification front, e.g., located more proximate to the sprue chamber, may act as a riser for the cavity 410. In various non-limiting embodiments, cavities may comprise multiple tapered sections. In certain non-limiting embodiments, the decreasing cross-section may prevent internal porosity from reaching the sprue chamber. In one non-limiting embodiment, the decreasing cross-section may form a density barrier to contain internal porosity such that it may be addressed by processing, such as by HIP, for example. For example, in use, at least a portion of the decreasing cross-section at or adjacent to the largest cross-section of the decreasing cross-section, e.g., at or adjacent to the molten material supply port 416, may be fully dense upon solidification, thereby preventing internal porosity from connecting to the sprue chamber where it may later become exposed when the casting is removed from the sprue chamber.

The mold 400 further includes insulation features comprising a plurality of pockets 418 defined in the sidewalls 412 defining the cavities 410. In various non-limiting embodiments, the sidewalls 412 of the mold 400 may also or alternatively comprise insulation features such as pockets similar to those illustrated in FIG. 9. For example, pockets defined in one or both of the sidewalls 412 may be structured to alter the heat capacity of the mold along a lateral portion of the sidewall 412. The pockets 418 are dimensioned and positioned to promote directional solidification from the back wall 414 toward the front face 406. As with other various non-limiting embodiments, the particular length, area, and/or position of the pockets 418 may be adjusted to suit specific parameters or pour conditions, e.g., pour temperature, mold volume, phase transformation characteristics of the metallic material, mold composition, cavity dimensions, number and proximity of cavities, and/or number and proximity of molds. In certain non-limiting embodiments, the mold may comprise two or more modular sections. The modular sections, for example, may comprise horizontal, vertical, angled, or slotted cross-sections to assist in removal of castings.

Figure 11:
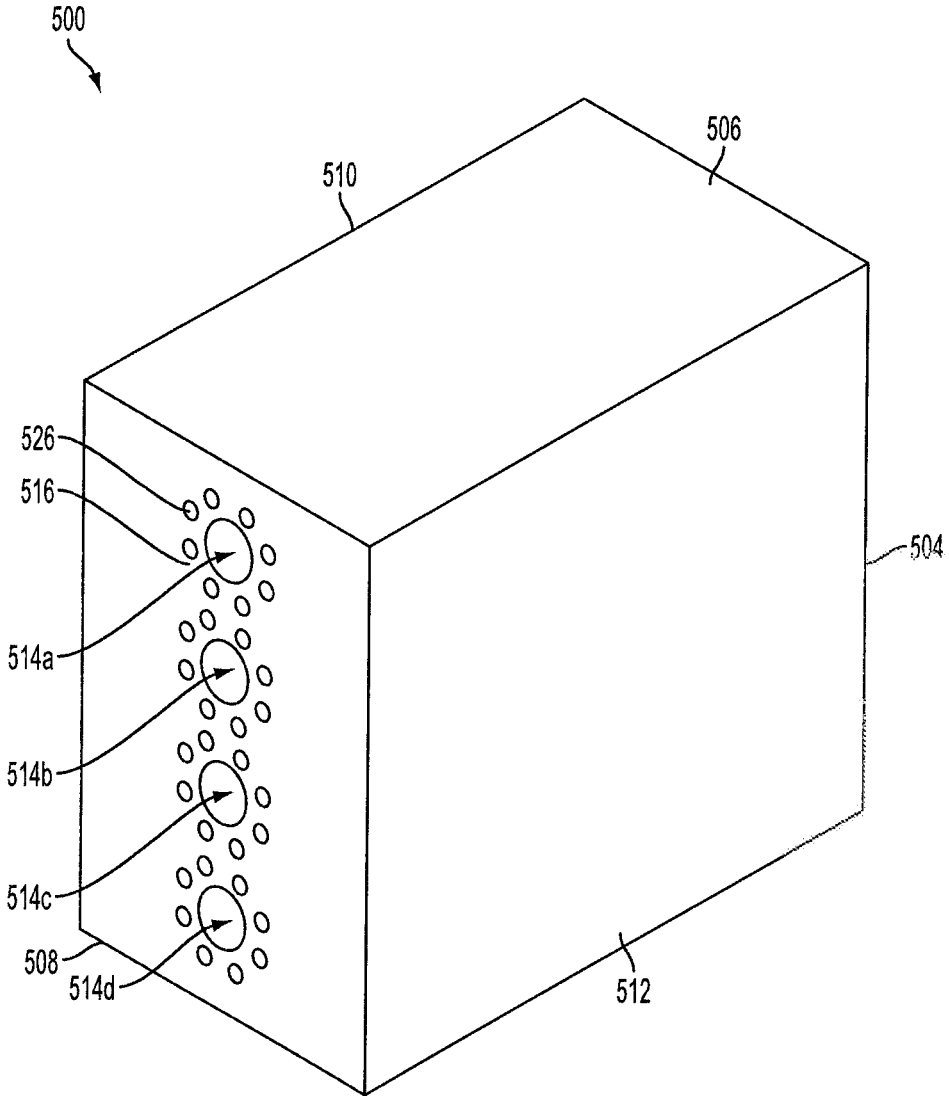
FIG. 11 is a perspective view of a mold according to various non-limiting embodiments of the present disclosure.

FIG. 11 illustrates a mold 500 for use in a centrifugal casting apparatus according to various non-limiting embodiments of the present disclosure. The mold 500 comprises a front face 502, a back face 504, an upper face 506, a lower face 508, a first side face 510, and a second side face 512. Four stacked cavities 514*a*-514*d* extend into the mold 500 from the front face 502 toward the back face 504. Each cavity 514*a*-514*d* is defined by a sidewall 516. The mold 500 further defines insulation features comprising a plurality of pockets 526 positioned about each cavity 514*a*-514*d*. As shown, the pockets 526 are equally spaced about the cavities 514*a*-514*d*. In certain non-limiting embodiments, however, the number, spacing, and/or dimensions of one or more pockets 526 may be different. While not shown in FIGS. 11-15, the mold 500 may further comprise gate sections at or near portions of the cavities 514*a*-514*d* adjacent to the front face 502 of the mold 500. Gate sections may be defined in the mold 500 or may be attachable, for example, to the front face 502.

Figure 12:
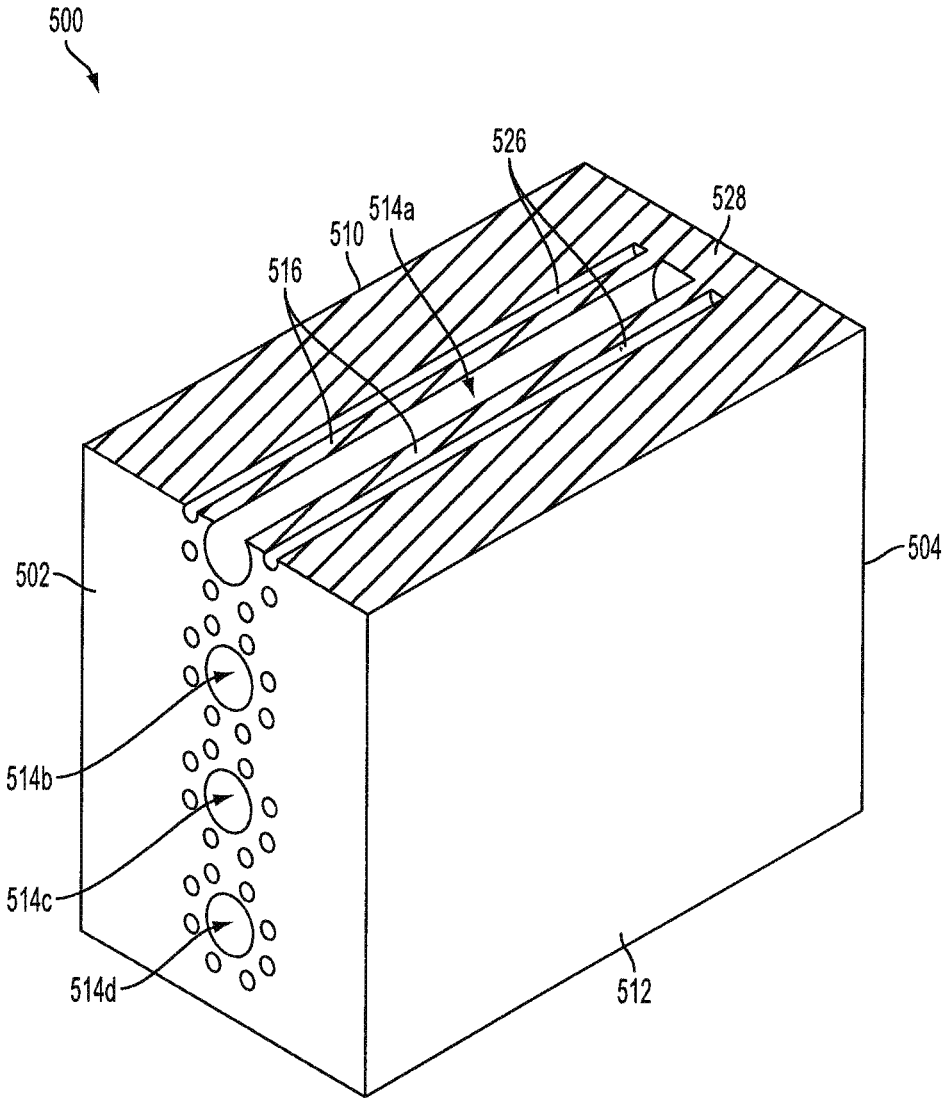
FIG. 12 is a perspective view of a cross-section through the first cavity of the mold illustrated in FIG. 11 according to one non-limiting embodiment of the present disclosure.
Figure 13:
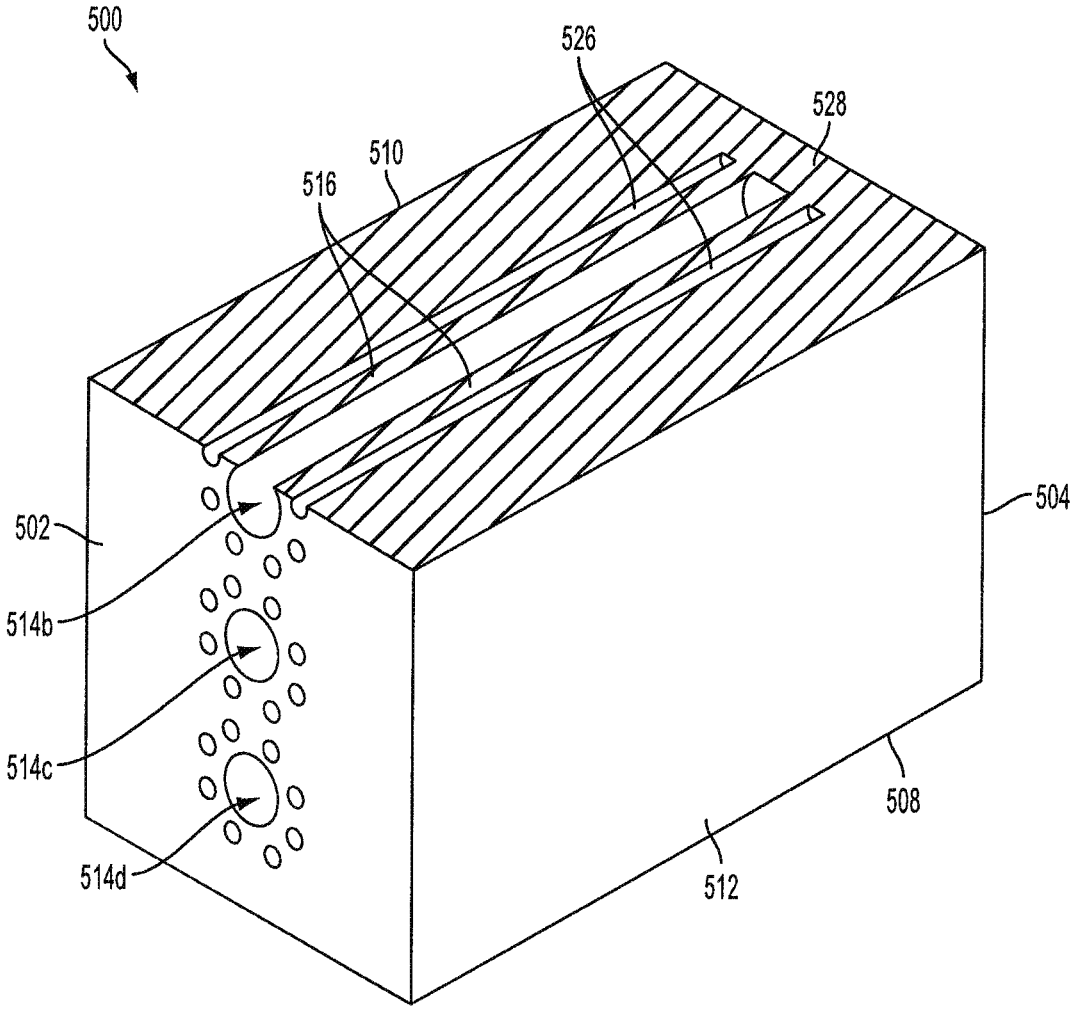
FIG. 13 is a perspective view of a cross-section through the second cavity of the mold illustrated in FIG. 11 according to one non-limiting embodiment of the present disclosure.

FIGS. 12-15 illustrate cross-sections of the mold 500 along the cavities 514*a*-514*d* according to various non-limiting embodiments of the present disclosure. FIGS. 12-13 depict cross-sections along the first and second cavities 514*a*, 514*b*, respectively. The cavities 514*a*, 514*b* extend from the front face 502 of the mold 500 to respective back walls 528, which are positioned adjacent to the back face 504. The cavities 514*a*, 514*b* extend substantially perpendicular to a plane defined by the front face 502. In operation, e.g., when the mold 500 is rotated about an axis of rotation, the angular velocity of the cavities 514*a*, 514*b* is substantially perpendicular to a radius extending from the center of rotation. The pockets 526 extend substantially parallel to the cavities 514*a*, 514*b* and are configured to reduce the heat capacity of the sidewall adjacent to the cavities 514*a*, 514*b* and limit the rate of heat transfer from the molten material to the mold 500. In the illustrated non-limiting embodiment, the back walls 528 represent a complete condition of thermal heat extraction from the molten material to the mold. Accordingly, rate of heat extraction from the molten material may be differentially controlled to promote directional solidification generally from the back walls 528 toward the front face. As stated above, when the mold 500 is rotated, centrifugal force may direct molten material toward and against the solidification front to reduce shrinkage porosity.

Figure 14:
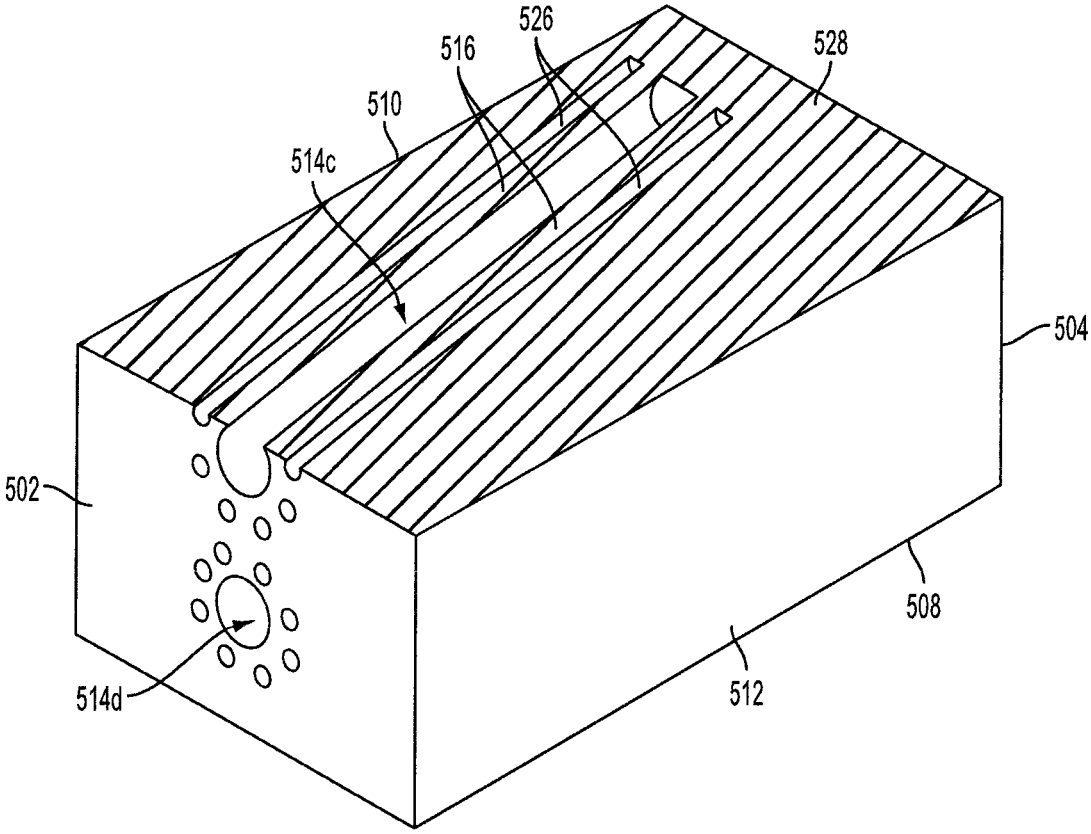
FIG. 14 is a perspective view of a cross-section through the third cavity of the mold illustrated in FIG. 11 according to one non-limiting embodiment of the present disclosure.
Figure 15:
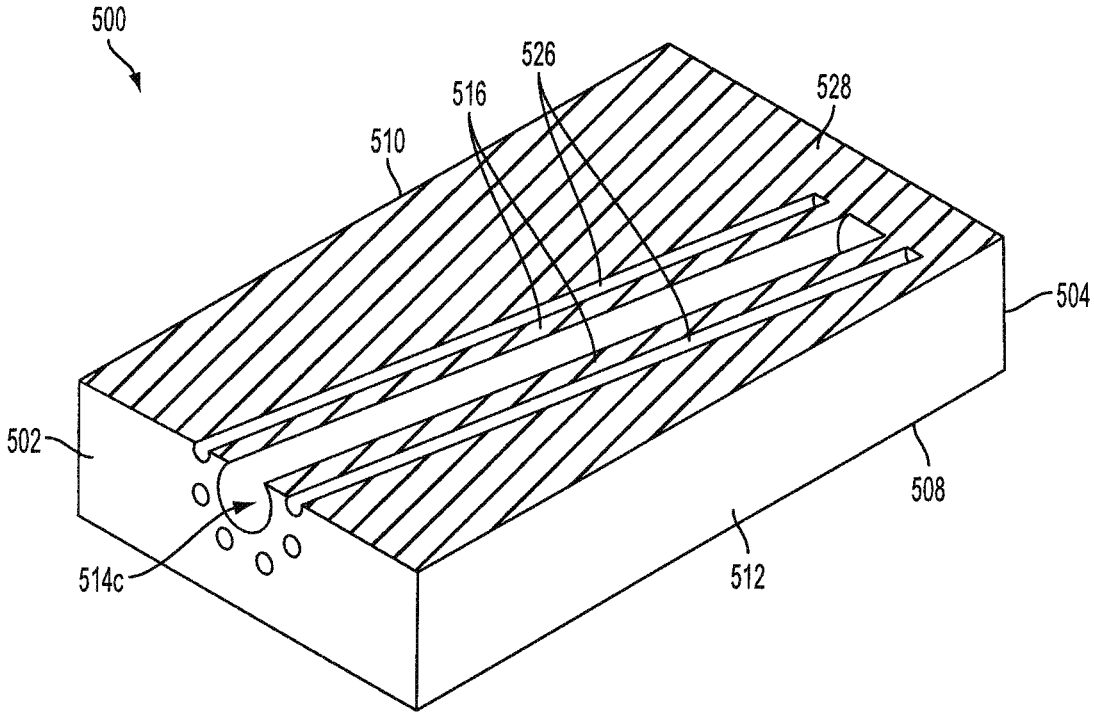
FIG. 15 is a perspective view of a cross-section through the fourth cavity of the mold illustrated in FIG. 11 according to one non-limiting embodiment of the present disclosure.

FIGS. 14-15 illustrate variations in arrangements of the cavities and show radially offset cavities. FIG. 14 illustrates a cross-section of the mold 500 along the third cavity 514*c*, which extends from the front face 502 toward the back wall 528. The pockets 526 extend substantially parallel to the cavity 514*c* and are configured to reduce the rate of heat transfer from the molten material to the mold 500, as described above. The cavity 514*c* is radially offset and defines about a 15 degree angle with respect to the second cavity 514*b*. FIG. 15 illustrates a cross-section of the mold 500 along the fourth cavity 514*d*, which extends from the front face 502 toward the back wall 528. The pockets 526 extend substantially parallel to the cavity 514*d* and are configured to reduce the rate of heat transfer from the molten material to the mold 500, as described above. The cavity is radially offset and defines about a 15 degree angle with respect to the second cavity 514*b* and about a 30 degree angle with respect to the third cavity 514*c*. Thus, the third and fourth cavities 514*a*, 514*b* may be radially offset, e.g., the angular velocity of a centerline of the cavity is not perpendicular to a radius originating at the center of rotation. However, as above, the back walls 528 represent a complete condition of thermal heat extraction from the molten material to the mold. Accordingly, rate of heat extraction from the material may be differentially controlled to promote directional solidification from the back walls 528 toward the front face. As stated above, when the mold 500 is rotated, centrifugal force will direct molten metallic material toward and against the solidification front to reduce shrinkage porosity.

It is appreciated that certain features of the centrifugal casting apparatuses and methods described herein are described in terms of illustrated embodiments. For example, for brevity and ease of understanding, only a limited number of variations with respect to the number and arrangement of molds and cavities are illustrated. As will become apparent to one of ordinary skill in the art after reading this document, the illustrated embodiments and their various alternatives may be implemented without confinement to the illustrated examples. The present disclosure is also not limited to the illustrated cavity or mold arrangements. For example, in various embodiments, molds may comprise multiple vertical stacks of cavities. Stacked cavities may comprise molds comprising multiple rows of stacked cavities. Stacked cavities may also comprise one or more cavities radially offset from the center of rotation. For example, a mold may comprise a stack of cavities wherein all the cavities are radially offset. In some non-limiting embodiments, stacked cavities may comprise multiple rows of stacked cavities. While the illustrated embodiments generally show stacked cavities where at least the material supply ports are aligned, in various non-limiting embodiments, cavities may be stacked such that one or more cavities are not aligned, e.g., cavities may be staggered or offset at uniform or non-uniform intervals.

It is to be appreciated that the configuration and number of molds may generally be related to the size and number of pieces to be cast and the volume of the sprue. For example, in various non-limiting embodiments, casting apparatuses may comprise a plurality of molds positioned about a rotation axis. The plurality of molds may each define a vertical stack of a plurality of cavities. Each of the plurality of cavities may define a plurality of linearly arranged cast pieces. Thus, depending on the configuration, various embodiments of the casting apparatuses may produce two to many hundreds of castings in a single casting run. That is, casting apparatuses comprising, for example, two to ten molds, each mold defining two to ten cavities, and each cavity defining two to six cast pieces, may produce between 8 and 600 cast pieces.

In the present description, other than in the operating examples or where otherwise indicated, all numbers expressing quantities or characteristics of elements, ingredients and products, processing conditions, and the like are to be understood as being modified in all instances by the term "about." Accordingly, unless indicated to the contrary, any numerical parameters set forth in the following description are approximations that may vary depending upon the desired properties one seeks to obtain in the apparatuses and methods according to the present disclosure. At the very least, and not as an attempt to limit the application of the doctrine of equivalents to the scope of the claims, each numerical parameter should at least be construed in light of the number of reported significant digits and by applying ordinary rounding techniques.

This disclosure describes various elements, features, aspects, and advantages of various non-limiting embodiments of centrifugal casting apparatuses and methods thereof. It is to be understood that certain descriptions of the various non-limiting embodiments have been simplified to illustrate only those elements, features and aspects that are relevant to a more clear understanding of the disclosed embodiments, while eliminating, for purposes of brevity or clarity, other elements, features and aspects. It is appreciated that certain features, which are, for clarity, described in the context of separate embodiments, may also be provided in combination in a single embodiment. Conversely, various features of the invention, which are, for brevity, described in the context of a single embodiment, may also be provided separately, in any suitable subcombination, or as suitable in any other described embodiment. For example, while the cavities are generally shown to extend along a horizontal operating plane, in various non-limiting embodiments, cavities may extend at positive and/or negative angles with respect to a horizontal operating plane. Additionally, certain features described in the context of various embodiments are not to be considered essential features of those embodiments, unless the embodiment is inoperative without those elements.

Although the foregoing description has necessarily presented only a limited number of embodiments, those of ordinary skill in the relevant art will appreciate that various changes in the apparatuses and methods and other details of the examples that have been described and illustrated herein may be made by those skilled in the art, and all such modifications will remain within the principle and scope of the present disclosure as expressed herein and in the appended claims. Those having ordinary skill, upon reading the present description, will readily identify additional centrifugal casting apparatuses and methods and may design, build, and use additional centrifugal casting apparatuses and methods along the lines and within the spirit of the necessarily limited number of embodiments discussed herein. It is understood, therefore, that the present invention is not limited to the particular embodiments or methods disclosed or incorporated herein, but is intended to cover modifications that are within the principle and scope of the invention, as defined by the claims. It will also be appreciated by those skilled in the art that changes could be made to the non-limiting embodiments and methods discussed herein without departing from the broad inventive concept thereof.

What is claimed is:

1. A centrifugal casting apparatus comprising:

a rotatable assembly configured to rotate about a rotation axis, wherein the rotatable assembly comprises:

a sprue chamber positioned about the rotation axis and structured to receive a supply of molten material;

a first gate positioned to receive molten material from the sprue chamber in a general direction of centrifugal force;

a second gate positioned to receive molten material from the sprue chamber in the general direction of centrifugal force;

a first cavity positioned to receive molten material from the first gate in the general direction of centrifugal force, wherein the first gate comprises a volume greater than a volume of an equal adjacent length of the first cavity; and a second cavity positioned to receive molten material from the second gate in the general direction of centrifugal force;

wherein the first cavity and the second cavity are stacked.

2. The centrifugal casting apparatus of claim 1, wherein the first gate comprises a diameter larger than a diameter of the first cavity.

3. The centrifugal casting apparatus of claim 2, wherein the first gate comprises a cross-sectional area between 125% and 150% of a cross-sectional area of the first cavity, and a length between 50% and 150% of the largest dimension of a cross-section of the first gate.

4. The centrifugal casting apparatus of claim 1, wherein the first and second cavities are configured to promote directional solidification of molten material within the first and second cavities generally extending toward the sprue chamber.

5. The centrifugal casting apparatus of claim 1, further comprising a mold defining the first and second cavities, wherein each of the first and second cavities is defined by a sidewall and a back wall.

6. The centrifugal casting apparatus of claim 5, wherein the mold comprises a front face, and wherein the sprue chamber is at least partially defined by the front face of the mold.

7. The centrifugal casting apparatus of claim 5, wherein the mold is structured to differentially control heat extraction from the molten material in the first and second cavities to promote directional solidification of molten material in the first and second cavities from the back walls generally extending toward the sprue chamber and counter to the general direction of centrifugal force.

8. The centrifugal casting apparatus of claim 7, wherein a thickness of at least one of the back walls is greater than a thickness of at least one of the sidewalls.

9. The centrifugal casting apparatus of claim 7, wherein at least one of the back walls and at least one of the sidewalls along the first and second cavities includes heat extraction properties sufficient to provide formation of a solidification front as the molten material undergoes solidification in a general direction toward the sprue chamber.

10. The centrifugal casting apparatus of claim 7, wherein at least one of the sidewalls comprises a thickness of less than 1 inch.

11. The centrifugal casting apparatus of claim 7, wherein the mold defines one or more pockets configured to modify a rate of heat transfer from the molten material to the mold.

12. The centrifugal casting apparatus of claim 1, wherein the sprue chamber is configured to supply molten material to the first and second cavities substantially continuously until both the first and second cavities are filled with molten material, and wherein the first and second gates are configured to be completely submerged in the molten material when both cavities are filled with the molten material.

13. The centrifugal casting apparatus of claim 1, wherein at least one of the first cavity and the second cavity is structured to produce a casting comprising a plurality of pieces.

14. The centrifugal casting apparatus of claim 1, wherein the rotatable assembly comprises a containment ring, wherein the containment ring comprises an overhang with respect to the sprue chamber.

15. The centrifugal casting apparatus of claim 5, wherein the rotatable assembly comprises a wedge forming a base of the sprue, wherein the wedge is configured for sealing engagement with the mold.

16. A centrifugal casting mold comprising:

a front face configured to receive a supply of molten material;

a back face;

a first cavity and a second cavity, each extending from the front face toward the back face and defined by a sidewall and a back wall adjacent to the back face of the mold, wherein the first and second cavities are stacked and configured to receive molten material in a general direction of centrifugal force extending radially outward from a rotational axis of the mold; and a first gate defined in the mold positioned between the front face and the first cavity, wherein the first gate is configured to receive molten material in a general direction of centrifugal force extending radially outward from the rotational axis of the mold, and wherein the first gate comprises a volume greater than a volume of an equal adjacent length of the first cavity;

wherein the mold is structured to differentially insulate each of the first and second cavities such that for each of the first and second cavities a rate of heat extraction from the molten material is greater at the back wall than a rate of heat extraction at the sidewall, promoting directional solidification from the back wall in a general direction extending toward the rotational axis of the mold.

17. The centrifugal casting mold of claim 16, wherein the mold defines one or more pockets configured to modify a rate of heat transfer from the molten material to the mold.

18. The centrifugal casting mold of claim 16, wherein a thickness of the back walls is greater than a thickness of the sidewalls.

19. The centrifugal casting mold of claim 16, wherein the back wall defining one of the first cavity or the second cavity is structured to provide substantially complete thermal heat extraction of molten material within the first cavity or the second cavity.

20. The centrifugal casting mold of claim 16, wherein the sidewall defining one of the first cavity and the second cavity comprises a thickness of less than 1 inch.

21. The centrifugal casting mold of claim 16, wherein a portion of each of the first and second cavities adjacent to the front face is tapered toward the back wall.

22. The centrifugal casting mold of claim 16, wherein the front face is configured to define at least a portion of a sprue chamber.

23. The centrifugal casting mold of claim 16, wherein at least one of the first cavity and the second cavity is configured to produce a casting comprising a plurality of pieces.

24. The centrifugal casting mold of claim 23, wherein a riser is positioned along a centerline of at least one of the first cavity and the second cavity.

25. The centrifugal casting mold of claim 16, wherein the mold is structured to differentially insulate each of the first and second cavities such for each of the first and second cavities a rate of heat extraction from the molten material by the back wall is greater than a rate of heat extraction from the molten material by the sidewall, thereby promoting directional solidification of molten material in a general direction extending from the back wall toward the front face.

26. A centrifugal casting mold comprising:

a front face configured to receive a supply of molten material;

a back face;

a first cavity extending from the front face toward the back face, the first cavity defined by a sidewall and a back wall adjacent to the back face of the mold; and a first gate defined in the mold positioned between the front face and the first cavity, wherein the first gate comprises a cross-sectional area larger than a cross-sectional area of the first cavity, and wherein the first gate is configured to receive molten material in a general direction of centrifugal force.

27. The centrifugal casting mold of claim 26, wherein the mold is structured to differentially control heat extraction from the molten material in the first cavity to promote directional solidification from the back wall generally toward the first gate and in a direction generally opposed to the general direction of centrifugal force.

28. The centrifugal casting mold of claim 27, wherein a thickness of the back wall is greater than the thickness of the sidewall.

29. The centrifugal casting mold of claim 27, wherein the back wall provides substantially complete thermal heat extraction from molten material within the first cavity.

30. The centrifugal casting mold of claim 27, wherein at least one of the sidewalls comprises a thickness less than 1 inch.

31. The centrifugal casting mold of claim 27, wherein the mold defines one or more pockets configured to modify a rate of heat transfer from the molten material to the mold.

32. The centrifugal casting mold of claim 27, wherein the front face is configured to define at least a portion of a sprue chamber.

33. The centrifugal casting mold of claim 26, wherein the first cavity is configured to produce a casting comprising a plurality of pieces.

34. The centrifugal casting mold of claim 26, wherein the mold further defines at least one additional cavity extending from the front face toward the back face, wherein the at least one additional cavity is defined by a sidewall and a back wall adjacent to the back face of the mold, and wherein the first cavity and the at least one additional cavity are stacked.

35. A centrifugal casting mold comprising:

a front face comprising a first material supply port configured to receive a supply of molten material;

a back face;

a first cavity extending from the first material supply port toward the back face, the first cavity defined by a sidewall and a back wall adjacent to the back face of the mold;

a first gate defined in the mold positioned between the front face and the first cavity, wherein the first gate is configured to receive molten material in a general direction of centrifugal force extending radially outward from a rotational axis of the mold, and wherein the first gate comprises a volume greater than a volume of an equal adjacent length of the first cavity; and the first cavity comprising a decreasing cross-sectional area along a length of the first cavity.

36. The centrifugal casting mold of claim 35, wherein the decreasing cross-sectional area comprises a first cross-section and a second cross-section, wherein the first cross-section is located at or near the material supply port, and wherein the second cross-section is located a greater distance from the material supply port than the first cross-section.

37. The centrifugal casting mold of claim 36, wherein a cross-sectional area of the first cross-section is greater than a cross-sectional area of the second cross-section.

38. The centrifugal casting mold of claim 35, wherein the front face comprises a second material supply port configured to receive a supply of molten material, and wherein the mold further comprises a second cavity extending from the second material supply port toward the back face, the second cavity defined by a sidewall and a back wall adjacent to the back face of the mold, wherein the second cavity comprises a decreasing cross-sectional area along a length of the second cavity.

39. The centrifugal casting mold of claim 35, wherein the mold is structured to promote directional solidification from the back face toward the front face.

40. The centrifugal casting mold of claim 35, wherein the front face is structured to attach to a sprue chamber.

41. The centrifugal casting mold of claim 35, wherein the first cavity comprises a continually decreasing cross-sectional area from the front face to the back face of the first cavity.

42. A centrifugal casting mold comprising:

a front face comprising a first material supply port and a second material supply port, the first and second material supply ports configured to receive a supply of molten material;

a back face;

a first cavity extending from the first material supply port toward the back face, the first cavity defined by a sidewall and a back wall adjacent to the back face of the mold, the first cavity comprising a continually decreasing cross-sectional area from the front face to the back face of the first cavity;

a first gate defined in the mold positioned between the front face and the first cavity, wherein the first gate comprises a cross-sectional area larger than a cross-sectional area of the first cavity, and wherein the first gate is configured to receive molten material in a general direction of centrifugal force extending radially outward from a rotational axis of the mold; and a second cavity extending from the second material supply port toward the back face, wherein the second cavity is defined by a sidewall and a back wall adjacent to the back face of the mold, the second cavity comprising a continually decreasing cross-sectional area from the front face to the back face of the second cavity and wherein the first cavity and the second cavity are stacked.

43. The centrifugal casting mold of claim 42, wherein at least one of the first cavity and the second cavity is structured to produce a casting comprising a plurality of pieces.

44. The centrifugal casting mold of claim 42, wherein the first and second cavities are configured to promote directional solidification from the back wall in a general direction extending toward the rotational axis of the mold.

45. The centrifugal casting mold of claim 42, wherein a thickness of at least one of the back walls is greater than a thickness of at least one of the sidewalls.

46. The centrifugal casting mold of claim 42, wherein at least one of the sidewalls comprises a thickness of less than 1 inch.

47. The centrifugal casting mold of claim 42, wherein the mold defines one or more pockets configured to modify a rate of heat transfer from the molten material to the mold.

48. A centrifugal casting apparatus comprising:

a rotatable assembly configured to rotate about a rotation axis, wherein the rotatable assembly comprises:

a sprue chamber positioned about the rotation axis and structured to receive a supply of molten material;

a first gate positioned to receive molten material from the sprue chamber in a general direction of centrifugal force;

a second gate positioned to receive molten material from the sprue chamber in the general direction of centrifugal force;

a first cavity positioned to receive molten material from the first gate in the general direction of centrifugal force, wherein the first gate comprises a diameter larger than a diameter of the first cavity; and a second cavity positioned to receive molten material from the second gate in the general direction of centrifugal force;

wherein the first cavity and the second cavity are stacked.

49. The centrifugal casting apparatus of claim 48, further comprising a mold defining the first and second cavities, wherein each of the first and second cavities is defined by a sidewall and a back wall.

50. The centrifugal casting apparatus of claim 49, wherein the mold comprises a front face, and wherein the sprue chamber is at least partially defined by the front face of the mold.

51. The centrifugal casting apparatus of claim 49, wherein the mold is structured to differentially control heat extraction from the molten material in the first and second cavities to promote directional solidification of the molten material from the back walls generally extending toward the sprue chamber and counter to the general direction of centrifugal force.

52. The centrifugal casting apparatus of claim 51, wherein a thickness of at least one of the back walls is greater than a thickness of at least one of the sidewalls.

53. A centrifugal casting apparatus comprising:

a rotatable assembly configured to rotate about a rotation axis, wherein the rotatable assembly comprises:

a sprue chamber positioned about the rotation axis and structured to receive a supply of molten material;

a first gate positioned to receive molten material from the sprue chamber in a general direction of centrifugal force;

a second gate positioned to receive molten material from the sprue chamber in the general direction of centrifugal force;

a first cavity positioned to receive molten material from the first gate in the general direction of centrifugal force, wherein the first gate comprises a diameter larger than a diameter of the first cavity, and wherein the first gate comprises a cross-sectional area between 125% and 150% of a cross-sectional area of the first cavity, and a length between 50% and 150% of the largest dimension of a cross-section of the first gate; and a second cavity positioned to receive molten material from the second gate in the general direction of centrifugal force;

wherein the first cavity and the second cavity are stacked.

54. The centrifugal casting apparatus of claim 53, further comprising a mold defining the first and second cavities, wherein each of the first and second cavities is defined by a sidewall and a back wall, and wherein the mold is structured to differentially control heat extraction from the molten material in the first and second cavities to promote directional solidification of the molten material from the back walls generally extending toward the sprue chamber and counter to the general direction of centrifugal force.

55. The centrifugal casting apparatus of claim 54, wherein at least one of the back walls and at least one of the sidewalls along the first and second cavities includes heat extraction properties sufficient to provide formation of a solidification front as the molten material undergoes solidification in a general direction toward the sprue chamber.

56. The centrifugal casting apparatus of claim 54, wherein at least one of the sidewalls comprises a thickness of less than 1 inch.

57. The centrifugal casting apparatus of claim 54, wherein the mold defines one or more pockets configured to modify a rate of heat transfer from the molten material to the mold.

58. A centrifugal casting mold comprising:

a front face configured to receive a supply of molten material;

a back face; and a first cavity and a second cavity, each extending from the front face toward the back face and defined by a sidewall and a back wall adjacent to the back face of the mold, wherein the first and second cavities are stacked and configured to receive molten material in a general direction of centrifugal force extending radially outward from a rotational axis of the mold; and a first gate defined in the mold positioned between the front face and the first cavity, wherein the first gate comprises a cross-sectional area larger than a cross-sectional area of the first cavity, and wherein the first gate is configured to receive molten material in a general direction of centrifugal force extending radially outward from the rotational axis of the mold;

wherein the mold is structured to differentially insulate each of the first and second cavities such that in each of the first and second cavities a rate of heat extraction from the molten material is greater at the back wall than a rate of heat extraction at the sidewall to promote directional solidification from the back wall in a general direction extending toward the rotational axis of the mold.

59. The centrifugal casting mold of claim 58, wherein the mold is structured to differentially insulate each of the first and second cavities such that in each of the first and second cavities a rate of heat extraction from the molten material by the back wall is greater than a rate of heat extraction from the molten material by the sidewall, thereby promoting directional solidification of molten material in a general direction extending from the back wall toward the front face.

60. A centrifugal casting mold comprising:

a front face comprising a first material supply port configured to receive a supply of molten material;

a back face;

a first cavity extending from the first material supply port toward the back face, the first cavity defined by a sidewall and a back wall adjacent to the back face of the mold;

a first gate defined in the mold positioned between the front face and the first cavity, wherein the first gate comprises a cross-sectional area larger than a cross-sectional area of the first cavity, and wherein the first gate is configured to receive molten material in a general direction of centrifugal force extending radially outward from a rotational axis of the mold; and the first cavity comprising a decreasing cross-sectional area along a length of the first cavity.

61. The centrifugal casting mold of claim 60, wherein the first cavity comprises a continually decreasing cross-sectional area from the front face to the back face of the first cavity.

62. A centrifugal casting mold comprising:

a front face comprising a first material supply port and a second material supply port, the first and second material supply ports configured to receive a supply of molten material;

a back face;

a first cavity extending from the first material supply port toward the back face, the first cavity defined by a sidewall and a back wall adjacent to the back face of the mold, the first cavity comprising a continually decreasing cross-sectional area from the front face to the back face of the first cavity;

a first gate defined in the mold positioned between the front face and the first cavity, wherein the first gate is configured to receive molten material in a general direction of centrifugal force extending radially outward from a rotational axis of the mold, and wherein the first gate comprises a volume greater than a volume of an equal adjacent length of the first cavity; and a second cavity extending from the second material supply port toward the back face, wherein the second cavity is defined by a sidewall and a back wall adjacent to the back face of the mold, the second cavity comprising a continually decreasing cross-sectional area from the front face to the back face of the second cavity and wherein the first cavity and the second cavity are stacked.

* * * * *